US009156043B2

(12) United States Patent
Walker

(10) Patent No.: US 9,156,043 B2
(45) Date of Patent: Oct. 13, 2015

(54) ARC ADJUSTABLE ROTARY SPRINKLER WITH AUTOMATIC MATCHED PRECIPITATION

(75) Inventor: Samuel C. Walker, Green Valley, AZ (US)

(73) Assignee: Rain Bird Corporation, Azusa, CA (US)

( * ) Notice: Subject to any disclaimer, the term of this patent is extended or adjusted under 35 U.S.C. 154(b) by 575 days.

(21) Appl. No.: 13/548,993

(22) Filed: Jul. 13, 2012

(65) Prior Publication Data

US 2014/0014738 A1 Jan. 16, 2014

(51) Int. Cl.

| | |
|---|---|
| ***B05B 3/04*** | (2006.01) |
| ***B05B 3/02*** | (2006.01) |
| ***B05B 1/32*** | (2006.01) |
| ***B05B 1/30*** | (2006.01) |
| *B05B 15/10* | (2006.01) |

(52) U.S. Cl.

CPC . *B05B 1/326* (2013.01); *B05B 1/30* (2013.01); *B05B 3/021* (2013.01); *B05B 3/0431* (2013.01); *B05B 3/0454* (2013.01); *B05B 15/10* (2013.01)

(58) Field of Classification Search

CPC ..... B05B 1/30; B05B 1/3026; B05B 1/3073; B05B 1/326; B05B 3/021; B05B 3/0431; B05B 3/0454; B05B 15/10

See application file for complete search history.

(56) References Cited

U.S. PATENT DOCUMENTS

| | | | |
|---|---|---|---|
| 2,625,411 | A | 4/1949 | Unger |
| 2,721,052 | A | 10/1955 | Hull |
| 2,950,132 | A | 11/1957 | Kocsuta |
| 2,999,701 | A | 9/1961 | Blair |
| 3,091,399 | A | 5/1963 | Kennedy |
| 3,095,148 | A | 6/1963 | Smith |
| 3,107,056 | A | 10/1963 | Hunter |
| 3,135,259 | A | 6/1964 | Evans |
| 3,204,988 | A | 9/1965 | Ouderkirk |
| 3,244,373 | A | 4/1966 | Hait |
| 3,940,066 | A | 2/1976 | Hunter |
| 4,059,227 | A | 11/1977 | Hunter |
| 4,119,275 | A | 10/1978 | Hunter |
| 4,149,358 | A | 4/1979 | Comer |
| 4,198,000 | A | 4/1980 | Hunter |
| 4,204,642 | A | 5/1980 | Hunter |
| 4,220,283 | A | 9/1980 | Citron |
| 4,265,404 | A | 5/1981 | Hunter |

(Continued)

FOREIGN PATENT DOCUMENTS

| | | |
|---|---|---|
| EP | 1864717 | 12/2007 |
| WO | 2004113777 | 12/2004 |

(Continued)

OTHER PUBLICATIONS

International Search Report, International Patent Application No. PCT/US2013/050072, dated Nov. 7, 2013, 2 pages.

*Primary Examiner* — Darren W Gorman

(74) *Attorney, Agent, or Firm* — Fitch, Even, Tabin & Flannery, LLP

(57) ABSTRACT

A rotary sprinkler is provided herein capable of providing automatic matched precipitation to arc adjustments. Sprinklers herein includes an arc setting assembly or mechanism that enables reversing, part-circle operation or, in some cases, full-circle operation with automatic matched precipitation coupled to the arc setting mechanism operable to effect automatic matched precipitation based on adjustments to the arc of rotation of the nozzle turret.

11 Claims, 15 Drawing Sheets

(56) References Cited

U.S. PATENT DOCUMENTS

| | | | |
|---|---|---|---|
| 4,272,024 | A | 6/1981 | Kah |
| 4,301,967 | A | 11/1981 | Hunter |
| 4,398,666 | A | 8/1983 | Hunter |
| 4,406,440 | A | 9/1983 | Kulle |
| 4,451,635 | A | 5/1984 | Gould |
| 4,471,908 | A | 9/1984 | Hunter |
| 4,501,391 | A | 2/1985 | Hunter |
| 4,559,653 | A | 12/1985 | Mathews |
| 4,569,485 | A | 2/1986 | Walto |
| 4,624,412 | A | 11/1986 | Hunter |
| 4,634,052 | A | 1/1987 | Grizzle |
| 4,635,975 | A | 1/1987 | Campbell |
| 4,637,636 | A | 1/1987 | Guest |
| 4,682,755 | A | 7/1987 | Bernstein |
| 4,708,290 | A | 11/1987 | Osmond |
| 4,732,861 | A | 3/1988 | Sinclair |
| 4,867,378 | A | 9/1989 | Kah |
| 4,919,337 | A | 4/1990 | VanLeeuwen |
| 4,955,542 | A | 9/1990 | Kah |
| 4,961,534 | A | 10/1990 | Tyler |
| 4,972,993 | A | 11/1990 | VanLeeuwen |
| 5,009,368 | A | 4/1991 | Streck |
| 5,031,840 | A | 7/1991 | Grundy |
| 5,050,800 | A | 9/1991 | Lamar |
| 5,052,621 | A | 10/1991 | Katzer |
| 5,097,861 | A | 3/1992 | Hopkins |
| 5,098,021 | A | 3/1992 | Kah |
| 5,115,977 | A | 5/1992 | Alkalay |
| 5,148,990 | A | 9/1992 | Kah |
| 5,148,991 | A | 9/1992 | Kah |
| 5,158,232 | A | 10/1992 | Tyler |
| 5,226,602 | A | 7/1993 | Cochran |
| 5,239,587 | A | 8/1993 | Muckelrath |
| 5,251,938 | A | 10/1993 | Erickson |
| 5,259,587 | A | 11/1993 | DAlessio |
| 5,288,023 | A | 2/1994 | Han |
| 5,291,842 | A | 3/1994 | Sallstrom |
| 5,330,103 | A | 7/1994 | Eckstein |
| 5,360,167 | A | 11/1994 | Grundy |
| 5,375,768 | A | 12/1994 | Clark |
| 5,383,600 | A | 1/1995 | Verbera |
| 5,394,678 | A | 3/1995 | Lonn |
| 5,417,370 | A | 5/1995 | Kah |
| 5,444,611 | A | 8/1995 | Woytowitz |
| RE35,037 | E | 9/1995 | Kah |
| 5,456,411 | A | 10/1995 | Scott |
| 5,462,251 | A | 10/1995 | Kawabe |
| 5,487,572 | A | 1/1996 | Combot-Courrau |
| 5,526,982 | A | 6/1996 | McKenzie |
| 5,527,073 | A | 6/1996 | Readman |
| 5,556,036 | A | 9/1996 | Chase |
| 5,588,594 | A | 12/1996 | Kah |
| 5,611,488 | A | 3/1997 | Frolich |
| 5,630,551 | A | 5/1997 | Forcier |
| 5,653,390 | A | 8/1997 | Kah |
| 5,673,855 | A | 10/1997 | Nguyen |
| 5,676,315 | A | 10/1997 | Han |
| 5,681,062 | A | 10/1997 | Fukao |
| 5,685,486 | A | 11/1997 | Spenser |
| D388,502 | S | 12/1997 | Kah |
| 5,695,122 | A | 12/1997 | Messinger |
| 5,695,123 | A | 12/1997 | Le |
| 5,695,224 | A | 12/1997 | Grenier |
| 5,699,962 | A | 12/1997 | Scott |
| 5,709,417 | A | 1/1998 | Verbeck |
| 5,722,593 | A | 3/1998 | McKenzie |
| 5,758,827 | A | 6/1998 | Van Le |
| 5,762,270 | A | 6/1998 | Kearby |
| 5,765,757 | A | 6/1998 | Bendall |
| 5,816,627 | A | 10/1998 | Readman |
| 5,823,440 | A | 10/1998 | Clark |
| 5,826,797 | A | 10/1998 | Kah |
| 5,868,316 | A | 2/1999 | Scott |
| 5,899,386 | A | 5/1999 | Miyasato |
| 5,911,443 | A | 6/1999 | LeQuere |
| 5,938,122 | A | 8/1999 | Heren |
| 5,975,430 | A | 11/1999 | Larsen |
| 5,992,760 | A | 11/1999 | Kearby |
| 6,000,632 | A | 12/1999 | Wallace |
| 6,029,907 | A | 2/2000 | McKenzie |
| 6,039,268 | A | 3/2000 | Grundy |
| 6,042,021 | A | 3/2000 | Clark |
| 6,050,502 | A | 4/2000 | Clark |
| 6,085,995 | A | 7/2000 | Kah |
| 6,109,545 | A | 8/2000 | Kah |
| 6,109,664 | A | 8/2000 | Guest |
| 6,138,924 | A | 10/2000 | Hunter |
| 6,155,493 | A | 12/2000 | Kearby |
| 6,168,577 | B1 | 1/2001 | Niederjohn |
| 6,182,909 | B1 | 2/2001 | Kah |
| 6,209,801 | B1 | 4/2001 | Kearby |
| 6,227,455 | B1 | 5/2001 | Scott |
| 6,231,090 | B1 | 5/2001 | Fukao |
| 6,237,862 | B1 | 5/2001 | Kah |
| 6,241,158 | B1 | 6/2001 | Clark |
| 6,244,521 | B1 | 6/2001 | Sesser |
| 6,293,147 | B1 | 9/2001 | Parker |
| 6,336,597 | B1 | 1/2002 | Kah |
| 6,351,929 | B1 | 3/2002 | Gust |
| 6,364,217 | B1 | 4/2002 | Lockwood |
| 6,464,151 | B1 | 10/2002 | Cordua |
| 6,488,401 | B1 | 12/2002 | Seaman |
| 6,491,235 | B1 | 12/2002 | Scott |
| 6,494,384 | B1 | 12/2002 | Meyer |
| 6,499,672 | B1 | 12/2002 | Sesser |
| 6,568,608 | B2 | 5/2003 | Sirkin |
| 6,601,781 | B2 | 8/2003 | Kah |
| 6,612,623 | B2 | 9/2003 | Salomon-Bahls |
| 6,637,672 | B2 | 10/2003 | Cordua |
| 6,651,905 | B2 | 11/2003 | Sesser |
| 6,655,830 | B1 | 12/2003 | Seaman |
| 6,663,145 | B1 | 12/2003 | Lyall, III |
| 6,695,223 | B2 | 2/2004 | Beutler |
| 6,712,796 | B2 | 3/2004 | Fentis |
| 6,721,630 | B1 | 4/2004 | Woytowitz |
| 6,722,629 | B1 | 4/2004 | Nakazawa |
| 6,732,950 | B2 | 5/2004 | Ingham |
| 6,732,952 | B2 | 5/2004 | Kah |
| 6,736,332 | B2 | 5/2004 | Sesser |
| 6,799,732 | B2 | 10/2004 | Sirkin |
| 6,802,458 | B2 | 10/2004 | Gregory |
| 6,814,305 | B2 | 11/2004 | Townsend |
| 6,817,543 | B2 | 11/2004 | Clark |
| 6,824,172 | B1 | 11/2004 | Komolrochanaporn |
| 6,827,291 | B2 | 12/2004 | Townsend |
| 6,834,816 | B2 | 12/2004 | Kah |
| 6,840,460 | B2 | 1/2005 | Clark |
| 6,842,667 | B2 | 1/2005 | Beutler |
| 6,848,124 | B2 | 2/2005 | Goettl |
| 6,848,632 | B2 | 2/2005 | Clark |
| 6,854,664 | B2 | 2/2005 | Smith |
| 6,869,026 | B2 | 3/2005 | McKenzie |
| 6,871,795 | B2 | 3/2005 | Anuskiewicz |
| 6,883,727 | B2 | 4/2005 | De Los Santos |
| 6,896,881 | B1 | 5/2005 | Russell |
| 6,899,355 | B2 | 5/2005 | Klein |
| 6,913,292 | B2 | 7/2005 | Snyder, Sr. |
| 6,921,029 | B2 | 7/2005 | Lockwood |
| 6,929,236 | B1 | 8/2005 | Height |
| 6,942,164 | B2 | 9/2005 | Walker |
| 6,945,471 | B2 | 9/2005 | McKenzie |
| 6,957,782 | B2 | 10/2005 | Clark |
| 6,988,747 | B2 | 1/2006 | Allen |
| 6,991,362 | B1 | 1/2006 | Seaman |
| 7,010,394 | B1 | 3/2006 | Runge |
| 7,017,831 | B2 | 3/2006 | Santiago |
| 7,028,920 | B2 | 4/2006 | Hekman |
| 7,032,836 | B2 | 4/2006 | Sesser |
| 7,032,844 | B2 | 4/2006 | Cordua |
| 7,040,553 | B2 | 5/2006 | Clark |
| 7,044,403 | B2 | 5/2006 | Kah |
| 7,090,146 | B1 | 8/2006 | Ericksen |
| 7,111,875 | B2 | 9/2006 | Ball |
| 7,121,593 | B2 | 10/2006 | Snyder, Sr. |

(56) References Cited

U.S. PATENT DOCUMENTS

| | | | |
|---|---|---|---|
| 7,133,749 | B2 | 11/2006 | Goldberg |
| 7,134,613 | B2 | 11/2006 | Kah, III |
| 7,143,692 | B2 | 12/2006 | Schmitt |
| 7,143,962 | B2 | 12/2006 | Kah |
| 7,152,814 | B1 | 12/2006 | Schapper |
| 7,159,795 | B2 | 1/2007 | Sesser |
| 7,168,632 | B2 | 1/2007 | Kates |
| 7,195,287 | B2 | 3/2007 | Wai |
| 7,225,057 | B2 | 5/2007 | Froman |
| 7,226,003 | B2 | 6/2007 | Kah |
| 7,232,078 | B2 | 6/2007 | Kah, Jr. |
| 7,232,081 | B2 | 6/2007 | Kah |
| 7,234,651 | B2 | 6/2007 | Mousavi |
| 7,255,291 | B1 | 8/2007 | Lo |
| 7,287,711 | B2 | 10/2007 | Crooks |
| 7,287,712 | B2 | 10/2007 | Kah, Jr. |
| 7,322,533 | B2 | 1/2008 | Grizzle |
| 7,325,753 | B2 | 2/2008 | Gregory |
| 7,337,988 | B2 | 3/2008 | McCormick |
| 7,363,113 | B2 | 4/2008 | Runge |
| RE40,440 | E | 7/2008 | Sesser |
| 7,392,936 | B1 | 7/2008 | Green |
| 7,392,956 | B2 | 7/2008 | McKenzie |
| 7,404,525 | B2 | 7/2008 | Santiago |
| 7,412,303 | B1 | 8/2008 | Porter |
| 7,422,752 | B2 | 9/2008 | Hirst |
| 7,429,005 | B2 | 9/2008 | Schapper |
| 7,472,840 | B2 | 1/2009 | Gregory |
| 7,478,526 | B2 | 1/2009 | McAfee |
| 7,500,619 | B2 | 3/2009 | Lockwood |
| 7,500,620 | B2 | 3/2009 | Cordua |
| 7,500,699 | B2 | 3/2009 | Snyder, Sr. |
| 7,530,606 | B1 | 5/2009 | Yang |
| 7,552,632 | B2 | 6/2009 | Runge |
| 7,574,284 | B2 | 8/2009 | Goldberg |
| 7,578,010 | B2 | 8/2009 | Goettl |
| 7,581,687 | B2 | 9/2009 | Feith |
| 7,584,023 | B1 | 9/2009 | Palmer |
| 7,590,471 | B2 | 9/2009 | Jacobsen |
| 7,597,273 | B2 | 10/2009 | McAfee |
| 7,611,077 | B2 | 11/2009 | Sesser |
| 7,621,464 | B2 | 11/2009 | Smith |
| 7,621,467 | B1 | 11/2009 | Garcia |
| 7,624,934 | B2 | 12/2009 | Breedlove |
| 7,629,590 | B2 | 12/2009 | Horsky |
| 7,677,469 | B1 | 3/2010 | Clark |
| 7,686,236 | B2 | 3/2010 | Alexander |
| 7,703,706 | B2 | 4/2010 | Walker |
| 7,717,475 | B2 | 5/2010 | Savelle |
| 7,748,646 | B2 | 7/2010 | Clark |
| 7,761,189 | B2 | 7/2010 | Froman |
| 7,766,259 | B2 | 8/2010 | Feith |
| 7,766,396 | B1 | 8/2010 | Elbaz |
| 7,793,868 | B2 | 9/2010 | Kah |
| 7,820,981 | B2 | 10/2010 | Horsky |
| 7,823,804 | B2 | 11/2010 | Cordua |
| 7,828,229 | B2 | 11/2010 | Kah |
| 7,834,816 | B2 | 11/2010 | Marino |
| 7,841,547 | B2 | 11/2010 | Kah |
| 7,850,094 | B2 | 12/2010 | Richmond |
| 7,853,363 | B1 | 12/2010 | Porter |
| 7,861,948 | B1 | 1/2011 | Crooks |
| 7,862,089 | B2 | 1/2011 | Crompton |
| 7,877,168 | B1 | 1/2011 | Porter |
| 7,912,588 | B2 | 3/2011 | Runge |
| 7,917,249 | B2 | 3/2011 | Jacobsen |
| 7,942,161 | B2 | 5/2011 | Crompton |
| 7,962,245 | B2 | 6/2011 | Runge |
| RE42,596 | E | 8/2011 | Sesser |
| 7,988,071 | B2 | 8/2011 | Bredberg |
| 8,006,919 | B2 | 8/2011 | Renquist |
| 8,020,788 | B2 | 9/2011 | Luettgen |
| 8,025,315 | B2 | 9/2011 | Schreckenberg |
| 8,033,578 | B2 | 10/2011 | DeWilde |
| 8,047,456 | B2 | 11/2011 | Kah |
| 8,074,456 | B2 | 12/2011 | Shah |
| 8,074,897 | B2 | 12/2011 | Hunnicutt |
| 8,113,443 | B2 | 2/2012 | Zur |
| 8,136,742 | B2 | 3/2012 | Cordua |
| 8,136,743 | B2 | 3/2012 | Kah, Jr. |
| 8,205,915 | B1 | 6/2012 | Crompton |
| 8,469,288 | B1 | 6/2013 | Clark |
| 8,474,733 | B1 | 7/2013 | Clark |
| 8,628,027 | B2 | 1/2014 | Kah, Jr. |
| 8,636,229 | B1 | 1/2014 | Clark |
| 8,636,230 | B1 | 1/2014 | Clark |
| 8,636,233 | B2 | 1/2014 | Clark |
| 8,727,238 | B1 | 5/2014 | Clark |
| 8,777,124 | B2 | 7/2014 | Clark |
| 8,955,767 | B1 | 2/2015 | Clark et al. |
| 8,955,768 | B1 | 2/2015 | Clark et al. |
| 8,991,725 | B2 | 3/2015 | Kah, Jr. |
| 8,991,730 | B2 | 3/2015 | Kah, Jr. et al. |
| 2001/0013557 | A1 | 8/2001 | Kah |
| 2002/0023972 | A1 | 2/2002 | Kah |
| 2002/0074432 | A1 | 6/2002 | Kah |
| 2002/0089175 | A1 | 7/2002 | Ericksen |
| 2002/0130202 | A1 | 9/2002 | Kah |
| 2002/0135184 | A1 | 9/2002 | Snyder |
| 2002/0158145 | A1 | 10/2002 | Schneider |
| 2003/0006306 | A1 | 1/2003 | Clark |
| 2003/0006307 | A1 | 1/2003 | Clark |
| 2003/0010842 | A1 | 1/2003 | Kah |
| 2003/0075620 | A1 | 4/2003 | Kah |
| 2003/0089796 | A1 | 5/2003 | Kah |
| 2003/0124704 | A1 | 7/2003 | Strittmatter |
| 2003/0155433 | A1 | 8/2003 | Gregory |
| 2004/0014053 | A1 | 1/2004 | Zerhusen |
| 2004/0050958 | A1 | 3/2004 | McKenzie |
| 2004/0108392 | A1 | 6/2004 | Kah |
| 2004/0164178 | A1 | 8/2004 | Kah |
| 2004/0195358 | A1 | 10/2004 | Santiago |
| 2004/0195400 | A1 | 10/2004 | Anuskiewicz |
| 2004/0239115 | A1 | 12/2004 | Wilk |
| 2004/0241703 | A1 | 12/2004 | DeSauvage |
| 2005/0009105 | A1 | 1/2005 | Goddard |
| 2005/0042216 | A1 | 2/2005 | Frantz |
| 2005/0054576 | A1 | 3/2005 | Siler-Khodr |
| 2005/0103887 | A1 | 5/2005 | McCormick |
| 2005/0103901 | A1 | 5/2005 | Kah |
| 2005/0133619 | A1 | 6/2005 | Clark |
| 2005/0146133 | A1 | 7/2005 | Snyder |
| 2005/0161534 | A1 | 7/2005 | Kah |
| 2005/0173557 | A1 | 8/2005 | Kah |
| 2005/0194461 | A1 | 9/2005 | Goldberg |
| 2005/0214218 | A1 | 9/2005 | Russell |
| 2005/0233448 | A1 | 10/2005 | Oh |
| 2006/0049275 | A1 | 3/2006 | Santiago |
| 2006/0184284 | A1 | 8/2006 | Froman |
| 2006/0219815 | A1 | 10/2006 | Hekman |
| 2006/0265852 | A1 | 11/2006 | Snyder |
| 2006/0278727 | A1 | 12/2006 | Kah |
| 2007/0034712 | A1 | 2/2007 | Kah |
| 2007/0075542 | A1 | 4/2007 | Glaze |
| 2007/0119975 | A1 | 5/2007 | Hunnicutt |
| 2007/0119976 | A1 | 5/2007 | Kah |
| 2007/0119978 | A1 | 5/2007 | Wang |
| 2007/0128315 | A1 | 6/2007 | Szydlowski |
| 2007/0131802 | A1 | 6/2007 | Kah |
| 2007/0235565 | A1 | 10/2007 | Kah |
| 2008/0034859 | A1 | 2/2008 | Runge |
| 2008/0054092 | A1 | 3/2008 | Alexander |
| 2008/0087743 | A1 | 4/2008 | Govrin |
| 2008/0128531 | A1 | 6/2008 | Kah |
| 2008/0142618 | A1 | 6/2008 | Smith |
| 2008/0257982 | A1 | 10/2008 | Kah |
| 2009/0053226 | A1 | 2/2009 | Crowley |
| 2009/0065606 | A1 | 3/2009 | Lee |
| 2009/0072048 | A1 | 3/2009 | Renquist |
| 2009/0130315 | A1 | 5/2009 | Vogel |
| 2009/0173803 | A1 | 7/2009 | Kah |
| 2009/0173804 | A1 | 7/2009 | Kah |
| 2009/0177330 | A1 | 7/2009 | Kah |
| 2009/0188988 | A1 | 7/2009 | Walker |

(56) References Cited

U.S. PATENT DOCUMENTS

| | | | |
|---|---|---|---|
| 2009/0278556 | A1 | 11/2009 | Man |
| 2010/0029053 | A1 | 2/2010 | Itokawa |
| 2010/0090024 | A1 | 4/2010 | Hunnicutt |
| 2010/0098632 | A1 | 4/2010 | Russell |
| 2010/0105865 | A1 | 4/2010 | Telford |
| 2010/0108787 | A1 | 5/2010 | Walker |
| 2010/0179310 | A1 | 7/2010 | Kamme |
| 2010/0187331 | A1 | 7/2010 | Clark |
| 2010/0236936 | A1 | 9/2010 | Brunner |
| 2010/0243762 | A1 | 9/2010 | Onofrio |
| 2010/0244438 | A1 | 9/2010 | Johanson |
| 2010/0276512 | A1 | 11/2010 | Nies |
| 2010/0301135 | A1 | 12/2010 | Hunnicutt |
| 2010/0301142 | A1 | 12/2010 | Hunnicutt |
| 2010/0327083 | A1 | 12/2010 | Kah |
| 2011/0017842 | A1 | 1/2011 | Nations |
| 2011/0036933 | A1 | 2/2011 | Kah |
| 2011/0036993 | A1 | 2/2011 | Mano |
| 2011/0043607 | A1 | 2/2011 | Grier |
| 2011/0045005 | A1 | 2/2011 | Crowley |
| 2011/0049875 | A1 | 3/2011 | Stults |
| 2011/0057048 | A1 | 3/2011 | McAfee |
| 2011/0084151 | A1 | 4/2011 | Dnn |
| 2011/0095521 | A1 | 4/2011 | Crompton |
| 2011/0108637 | A1 | 5/2011 | Kah |
| 2011/0114569 | A1 | 5/2011 | Kim |
| 2011/0121092 | A1 | 5/2011 | Scully |
| 2011/0121097 | A1 | 5/2011 | Walker |
| 2011/0238228 | A1 | 9/2011 | Woytowitz |
| 2011/0239310 | A1 | 9/2011 | Cheng |
| 2011/0248094 | A1 | 10/2011 | Robertson |
| 2011/0248097 | A1 | 10/2011 | Kim |
| 2011/0306169 | A1 | 12/2011 | Ye |
| 2011/0309161 | A1 | 12/2011 | Renquist |
| 2011/0309169 | A1 | 12/2011 | Kah |
| 2012/0012670 | A1 | 1/2012 | Kah |
| 2012/0041606 | A1 | 2/2012 | Standerfer |
| 2012/0043398 | A1 | 2/2012 | Clark |
| 2012/0061489 | A1 | 3/2012 | Hunnicutt |
| 2012/0118998 | A1 | 5/2012 | Drechsel |
| 2012/0138832 | A1 | 6/2012 | Townsend |
| 2013/0015273 | A1 | 1/2013 | Onofrio |
| 2013/0221128 | A1 | 8/2013 | Nations |

FOREIGN PATENT DOCUMENTS

| | | |
|---|---|---|
| WO | 2009152980 | 12/2009 |
| WO | 2014011877 | 1/2014 |

ARC ADJUSTABLE ROTARY SPRINKLER WITH AUTOMATIC MATCHED PRECIPITATION

FIELD

The field relates to irrigation sprinklers and, more particularly, to arc adjustable rotary irrigation sprinklers capable of automatically matching precipitation rates with arc adjustments.

BACKGROUND

Pop-up irrigation sprinklers, in some cases, are buried in the ground and include a stationary housing and a riser assembly mounted within the housing that cycles up during an irrigation cycle and, then, back down into the housing after irrigation is complete. During irrigation, pressurized water typically causes the riser assembly to elevate through an open upper end of the housing and rise above the ground level to distribute water to surrounding terrain. The pressurized water causes the riser assembly to travel upwards against the bias of a spring to the elevated spraying position to distribute water to surrounding terrain through one or more spray nozzles. When the irrigation cycle is completed, the pressurized water supply is shut off and the riser is spring-retracted back into the stationary housing.

A rotary irrigation sprinkler commonly includes a rotatable nozzle turret mounted at the upper end of the riser assembly. The turret includes one or more spray nozzles for distributing water and is rotated through an adjustable arcuate water distribution pattern. Rotary sprinklers commonly include a water-driven motor or other mechanism to transfer energy of the incoming water into a source of power to rotate the turret. One common mechanism uses a water-driven turbine and a gear reduction system to convert the high speed rotation of the turbine into relatively low speed turret rotation. During normal operation, the turret rotates to distribute water outwardly over surrounding terrain in an arcuate pattern.

Rotary sprinklers may also employ arc adjustment systems to change the relative arcuate distance between two stops that define the arcuate limits of rotation for the turret. One stop is commonly fixed with respect to the turret while the second stop can be selectively moved arcuately relative to the turret to increase or decrease the desired arc of coverage. The drive motor may employ a tripping tab that engages the stops and shifts the direction of rotation of the motor output to oscillate the turret in opposite rotary directions in order to distribute water of the designated arc defined by the stops.

There is generally a relationship between the amount of water discharged from a sprinkler nozzle relative to its arc of oscillation at a given speed of rotation. This is commonly referred to as the precipitation rate for the sprinkler, and it relates to how much irrigation water is projected onto a ground surface area defined within the arc of rotation. As the arc of rotation is increased or decreased, the flow of water through the nozzle should be adjusted accordingly so that the same precipitation rate is deposited on the ground independent of the sprinkler's arc of rotation. This concept is often referred to as a matched precipitation rate. Previously, a matched precipitation rate was achieved by switching nozzle configurations when the arc is changed by manually removing and inserting different nozzle inserts for each arc setting. As can be appreciated, this is a cumbersome task and requires multiple nozzle inserts configured for specific arcs of rotation. For example, a sprinkler may have one nozzle insert for a 45° arc of rotation and a different nozzle insert for a 90° arc of rotation. For non-standard arc settings (such as a 67° arc of rotation for example), there may not an appropriate standard-size nozzle insert to achieve matched precipitation. Thus, in many instances, the non-standard arc settings often rely on a less then desired nozzle insert that may be mismatched to the selected arc of rotation. That is, a 67° arc of rotation may need to rely on a 45° or a 75° nozzle insert, but such nozzle insert may not be tailored to provide a desired precipitation rate for a 67° arc of watering.

DETAILED DESCRIPTION OF THE PREFERRED EMBODIMENT

Figure 1:
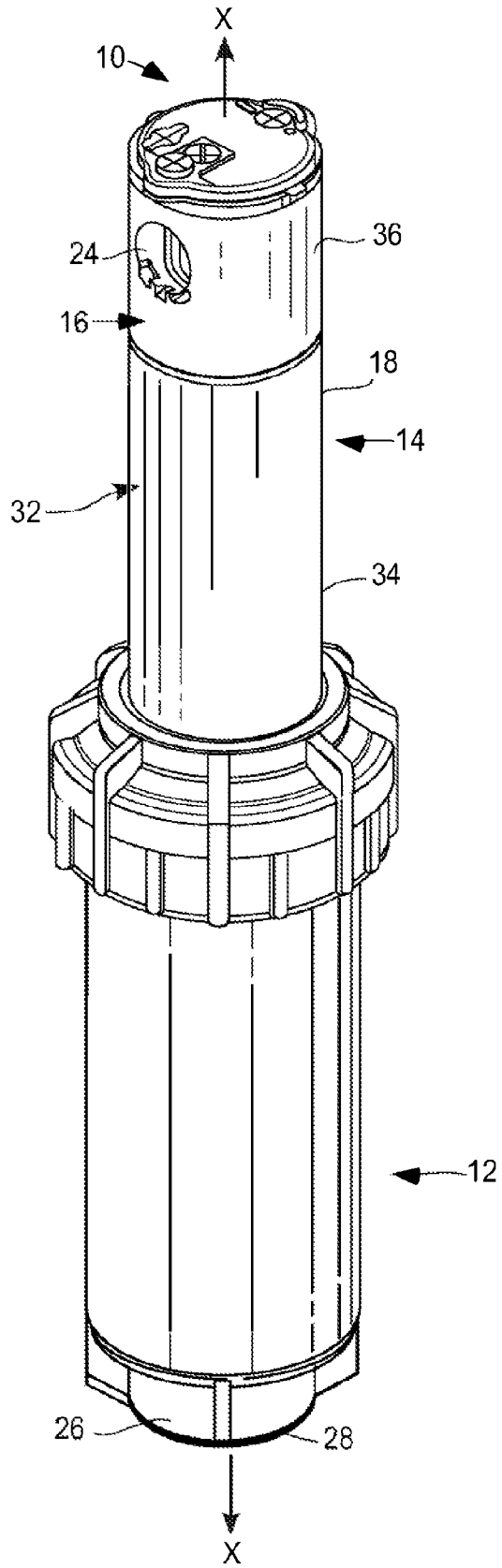
FIG. 1 is a perspective view of an irrigation sprinkler rotor shown with a riser assembly in an elevated position.
Figure 2:
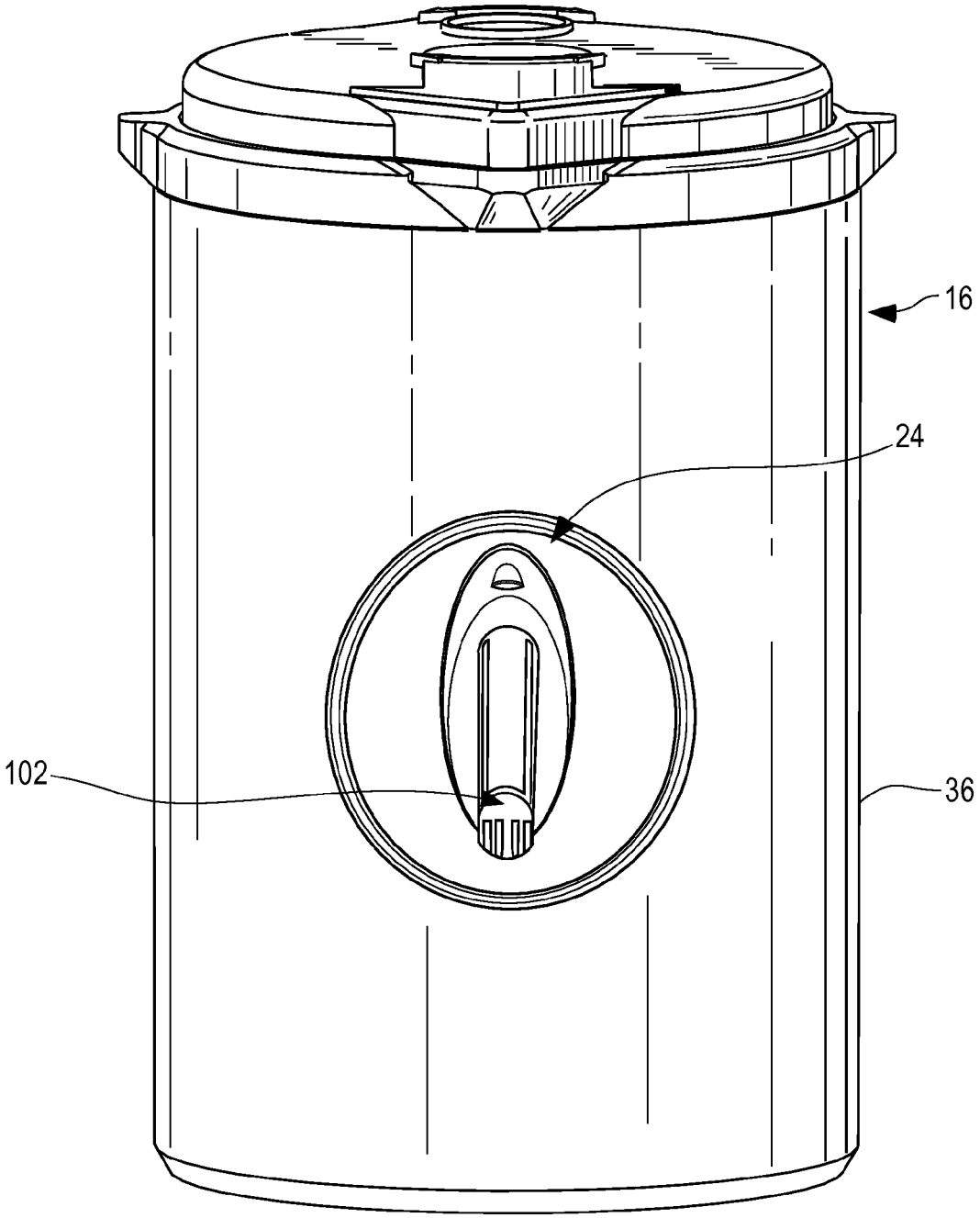
FIG. 2 is perspective view of an irrigation sprinkler rotor showing an exemplary nozzle turret.
Figure 3:
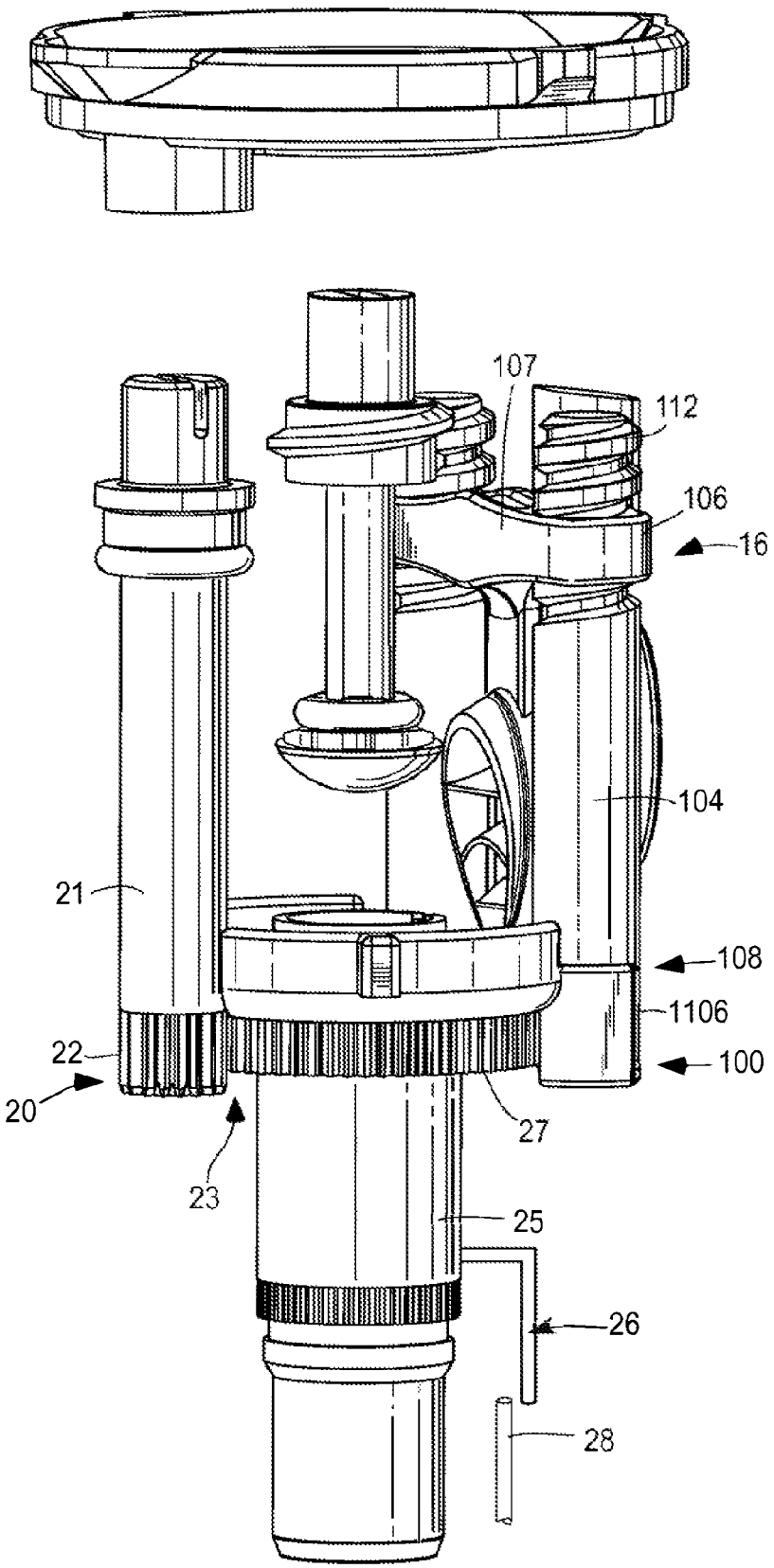
FIG. 3 is a perspective view of a nozzle turret.

As generally shown in FIGS. 1-3, one approach of a rotary pop-up sprinkler 10 capable of providing automatic matched precipitation to arc adjustments is illustrated with a base housing 12 having a longitudinal axis X, a pop-up riser assembly, stem, or housing 14 coupled with the base housing 12, and a rotatable nozzle turret 16 on an upper end 18 of the riser assembly 14. The sprinkler 10 includes an arc setting assembly or mechanism 20 (FIG. 3) that enables reversing, part-circle operation of the turret 16 or, in some cases, full-circle operation of the nozzle turret 16 as needed for a particular application. The sprinkler 10 further includes an automatic matched precipitation mechanism 100 (FIG. 3) coupled to the arc setting mechanism 20 operable to effect automatic matched precipitation based on adjustments to the arc of rotation of the nozzle turret 16.

Reversing, part-circle operation of the turret 16 is achieved by any number of mechanisms. One example of a suitable mechanism is a gear-drive mechanism, shiftable transmission, and arc setting assembly as generally described in U.S. Pat. No. 5,383,600, which is incorporated herein by reference in its entirety and provides further details of these sub-assemblies. It will be appreciated however, that other assemblies, components, and mechanisms that drive, shift, and/or adjust the nozzle turret rotation may also be used to operate the sprinkler 10 in part-circle operation.

In one aspect, the sprinkler 10 includes a variable geometry output nozzle configured and operable to provide automatic matched precipitation with changes to the nozzle turret's arc of rotation upon adjustment of the arc setting mechanism. To this end, as one or more of the stops used to define opposite arcuate ends of the nozzle turret's watering path are adjusted, the variable geometry nozzle is operative to automatically adjust its configuration to correctly compensate the geometry, profile, and/or shape of the nozzle outlet opening to vary the sprinkler's flow rate in order to match the precipitation rate for the selected arc of watering. In one approach, the sprinkler includes a flow control member arranged and configured to vary the geometry of the outlet to automatically adjust the sprinkler's flow rate proportional to the arc of rotation in order to provide substantially matched precipitation. At the same time, the sprinkler is also configured to maintain a substantially constant radius upon varying the flow rate such that, in some approaches, a generally consistent head-to-head spacing between adjacent sprinklers can be maintained while providing matched precipitation. Thus, the sprinklers herein, in one approach, may have matched precipitation for any adjustments of the arc of rotation of the nozzle turret between about 1 to about 360° of reversing rotation and, in other approaches, between about 40° to about 360° of reversing rotation. The sprinkler 10, as a result in some approaches, eliminates the need to manually adjust the nozzle or sprinkler (or switch between different nozzles) upon increasing or decreasing its arc of rotation to achieve the proper precipitation rate for the desired arc. The sprinkler 10 achieves a precipitation rate matched to the arc of rotation automatically upon adjustment of the sprinkler end stops defining the arc. In some instances, the nozzle and, in particular, the nozzle output may have a variable configuration arranged to automatically shift from a height-to-width ratio (a flow output aspect ratio) of about 1:1 to about 4:1 or larger depending on the arc of rotation.

In another aspect, the sprinkler 10 may include a nozzle output configured to reduce, compared to prior nozzles, turbulence and energy loss of irrigation fluid as the fluid transitions from an upwardly directed flow in the nozzle turret and housing to a transversely or generally transversely directed flow in the nozzle. In one approach of this aspect, the nozzle and/or nozzle turret may include transverse or cross flow vanes laterally disposed across a passage providing fluid flow. In another approach, the nozzle and/or nozzle turret may also include two transverse flow vanes. One may have a flat profile while a second flow vane may have a curved or arcuate profile. The flow vanes may be upstream of a fluid outlet from the nozzle or nozzle turret. In some approaches, the vanes may divide a flow passage upstream of the nozzle outlet into three or more sub passages converging back into a single passage at the nozzle outlet opening.

In yet another aspect, the sprinkler 10 may include a fixed flow break-up pin that is mounted to the nozzle turret to have no axial shifting thereof. The fixed flow break-up pin may be arranged and configured to cooperate with the automatic matched precipitation assembly of the output nozzle to progressively expose more and more of the fixed flow break-up pin as the variable geometry of the nozzle or fluid outlet is increased. By one approach and at small nozzle openings, the fixed flow break-up pin is not exposed to fluid being projected form the nozzle. As the geometry of the fluid or nozzle outlet is changed and increased in area, size, or shape, then the fixed flow break-up pin is progressively exposed to more and more of the fluid projected from the nozzle. By way of example, the fixed-break up pin may be arranged and configured on the nozzle turret so variations in the nozzle geometry result in a fixed pin that fully engages the flow stream at about 360° to about 300° of turret rotation, partially engages the flow stream from about 91 to about 299° of turret rotation (such as, for instance, about 180°), and not at all at about 90° or less of turret rotation. In some approaches, the flow break-up pin aids in maintaining the substantially constant radius or throw distance of the fluid projected from the sprinkler upon variations in the nozzle geometry.

In general, the features herein are suitable for a pop-up rotary sprinkler, but can be used with other types of sprinklers and spray heads as needed for a particular application. In one such application as generally shown in FIGS. 1 and 2, the riser assembly 14 travels cyclically between a spring-retracted position where the riser 14 is retracted into the housing 12 (not shown) and an elevated spraying position where the riser 14 is elevated out of the housing 12 (FIG. 1). The riser assembly 14 includes the rotatable nozzle turret 16 having at least one nozzle 24 therein for distributing water over a ground surface area. When the supply water is on, the riser assembly 14 extends above ground level so that water can be distributed from the nozzle 24 over the ground surface area for irrigation. When the water is shut off at the end of a watering cycle, the riser assembly 14 retracts into the housing 12 where it is protected from damage.

The housing 12 generally provides a protective covering for the riser assembly 14 and serves as a conduit for incoming water under pressure. The housing 12 preferably has the general shape of a cylindrical tube and is preferably made of a sturdy lightweight injection molded plastic or similar material. The housing 12 has a lower end 26 with an inlet 28 that may be coupled to a water supply pipe (not shown).

As generally shown in FIG. 1, the riser assembly 14 includes a non-rotatable, riser stem or housing 32 with a lower end 34 and the upper end 18. The rotatable turret 16 is rotatably mounted on the upper end 18 of the riser stem or housing 32. The rotatable turret 16 includes a housing or housing wall 36 that rotates relative to the stem 32 to water a predetermined pattern, which is adjustable from part-circle, reversing rotation or, in some cases, to full-circle, reversing or non-reversing rotation. The sprinklers illustrated herein are only exemplary and may take on other shapes and configurations as needed for a particular application.

Turning to more of the specifics, the sprinkler 10 includes an arc setting assembly 20 as generally shown in FIG. 3 (with the nozzle housing 36 removed and the nozzle top exploded upwardly for clarity). The arc setting assembly 20 allows manual adjustment of the arcuate sweep settings of the nozzle turret 16 by turning an arc set shaft 21 to manually increase or decrease the arcuate distance between two end stops 26 and 28 of the tripping mechanism. In one form, the arc setting assembly 20 includes the actuator 21 having a geared lower or distal end 22. The geared end 22 is mated via a geared relationship 23 to a ring gear 27, which is coupled to a central tube 25, and then to a first or adjustable stop 26. The non-rotatable stem or housing 14 also includes a second or fixed stop 28. As described more fully in U.S. Pat. No. 5,383,600, the sprinkler 10 may include a tripping tab (not shown here) that is configured to engage the stops 26 and 28 as the nozzle turret 16 rotates. The engagement of the tripping tab to the stops causes a transmission to shift direction of the rotation.

To adjust the first or adjustable stop 26 in the approach shown herein, a user actuates or turns the actuator 21, which is accessible at the top of the rotor nozzle. As the actuator 21 is turned, it imparts an opposite rotation to the ring gear 27 due to the geared relationship 23 between the actuator distal gear 22 mating with the gear 27. As the actuator 21 is turned, the gear 27 is turned to effect movement of the tab 26 in a circumferential direction. However, it will be appreciated that other mechanisms and devices may also be used to effect adjustment of the movable tab 26.

The sprinkler 10 may include automatic matched precipitation tied to the above describe arc setting mechanism 20.

Figure 6:
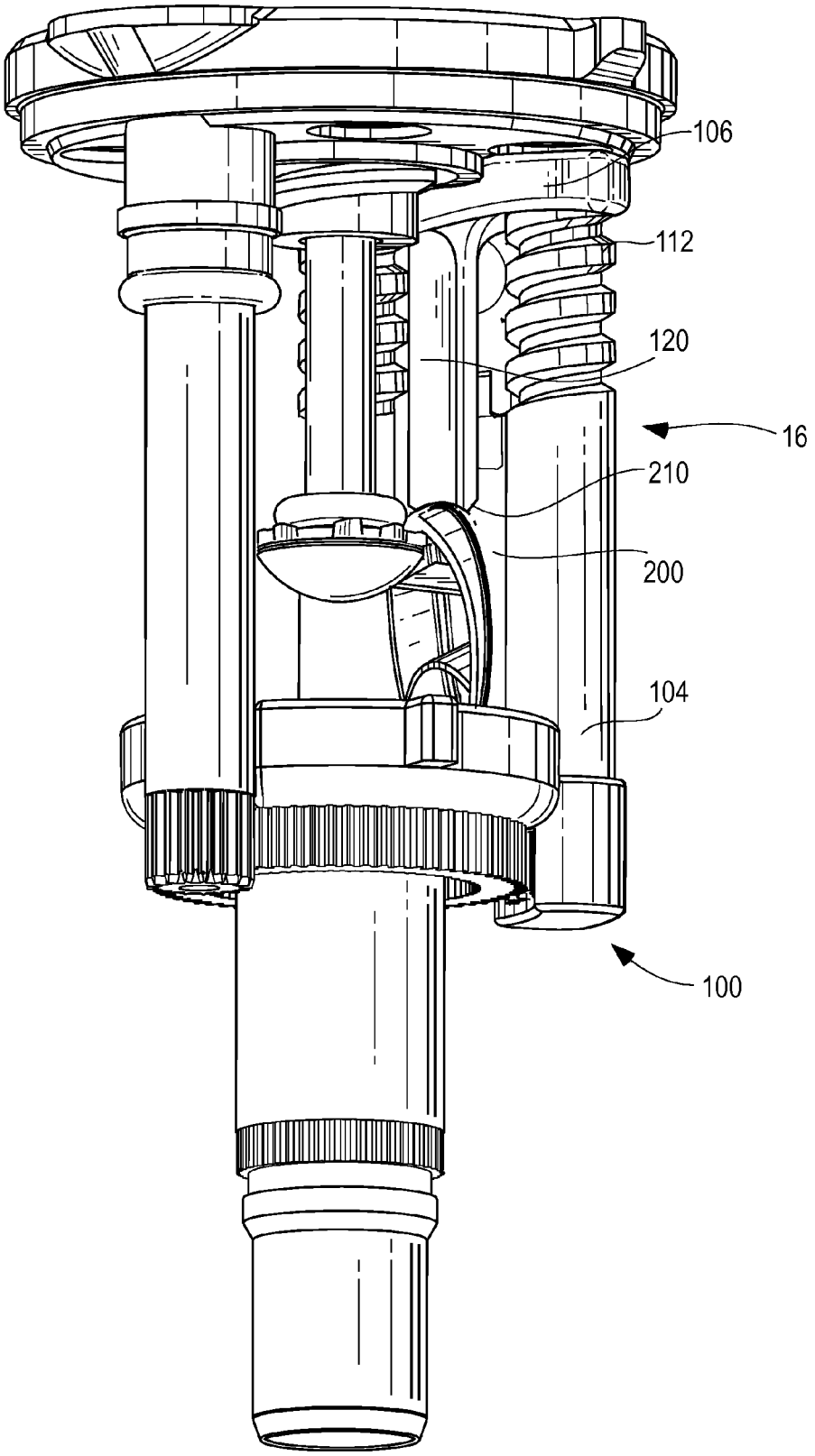
FIG. 6 is a perspective view of a nozzle turret.
Figure 7:
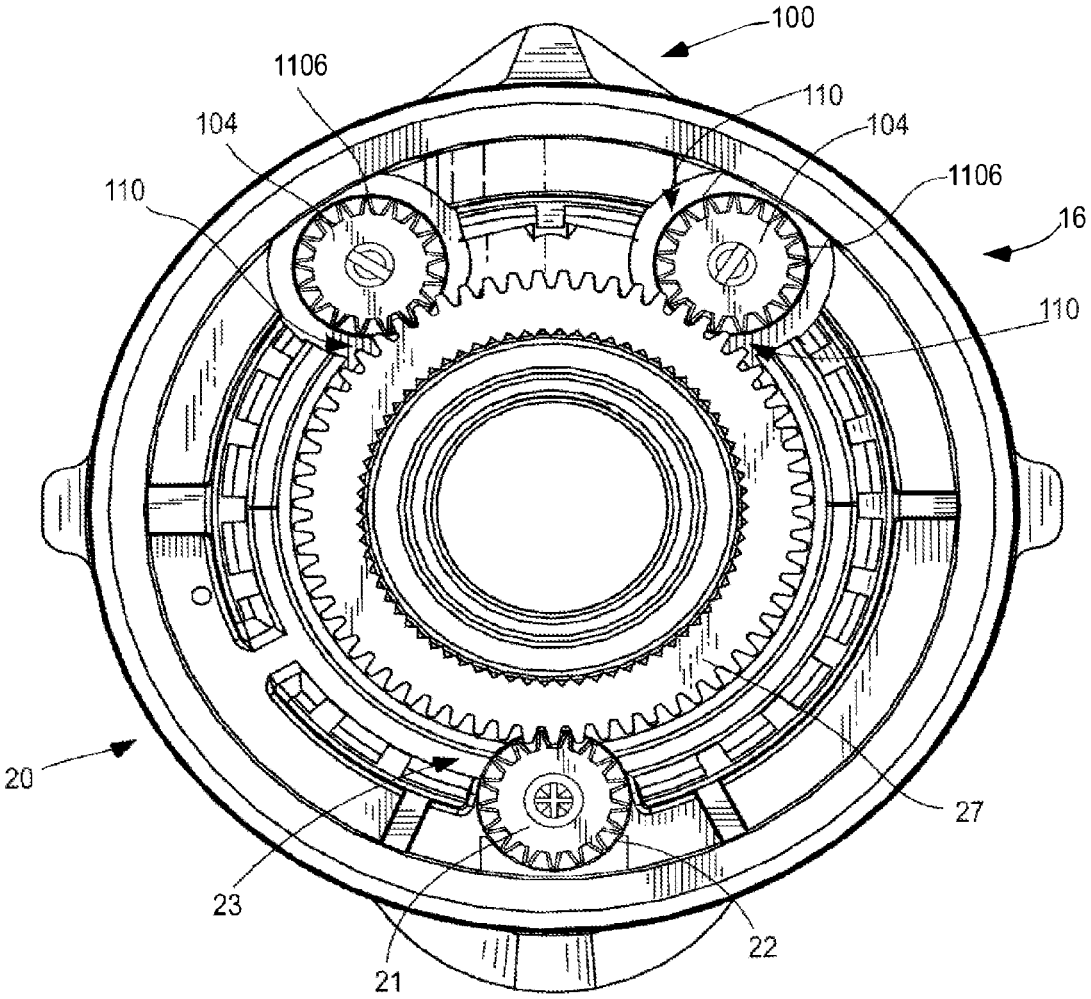
FIG. 7 is a cross-sectional view of a lower end of a nozzle turret.
Figure 8:
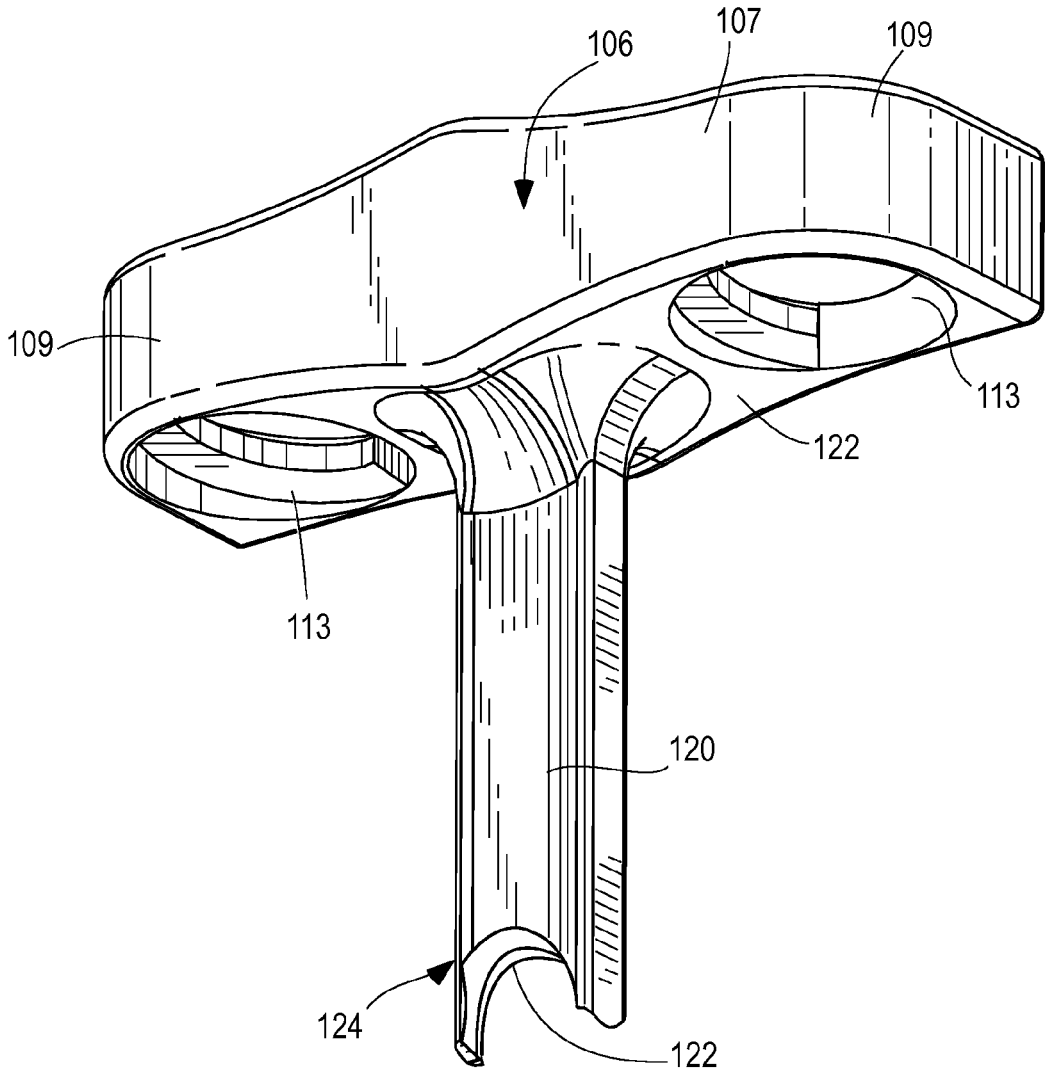
FIG. 8 is a perspective view of an exemplary flow control member or gate valve.

FIGS. 3 to 8 provide one example of a mechanism 100 coupling arc setting to automatic matched precipitation. FIGS. 3 through 6 show the nozzle housing 36 removed for clarity. FIG. 7 shows a cross-sectional view illustrating the geared relationships between the arc setting mechanism 20 and the automatic matched precipitation mechanism 100. FIG. 8 shows one example of an exemplary flow control member, such as a gate or gate valve, suitable for the mechanisms herein to achieve matched precipitation via axial shifting of a flow control member in the nozzle.

In general, the sprinkler 10 may be configured to automatically vary the size, shape, geometry and/or configuration of a nozzle outlet opening 102 proportionally based on changes to the arcuate sweep of the nozzle turret between the stops 26 and 28. Such automatic changes generally minimize or limit the need for manual switching of the individual nozzle inserts to change the shape of the outlet and generally provide for an infinite number of matchings between arc setting and precipitation rates as the arcuate setting is changed.

Figure 4:
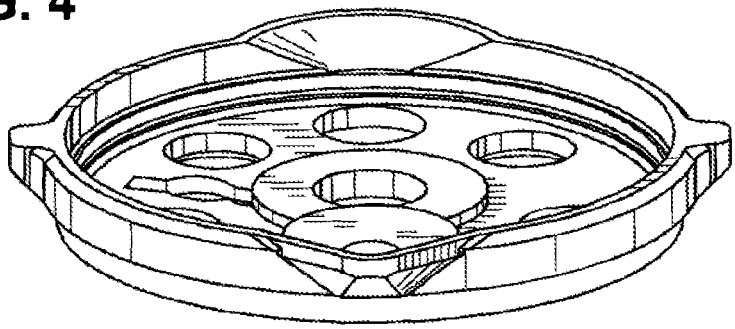
FIG. 4 is a perspective view of a nozzle turret.
Figure 4:
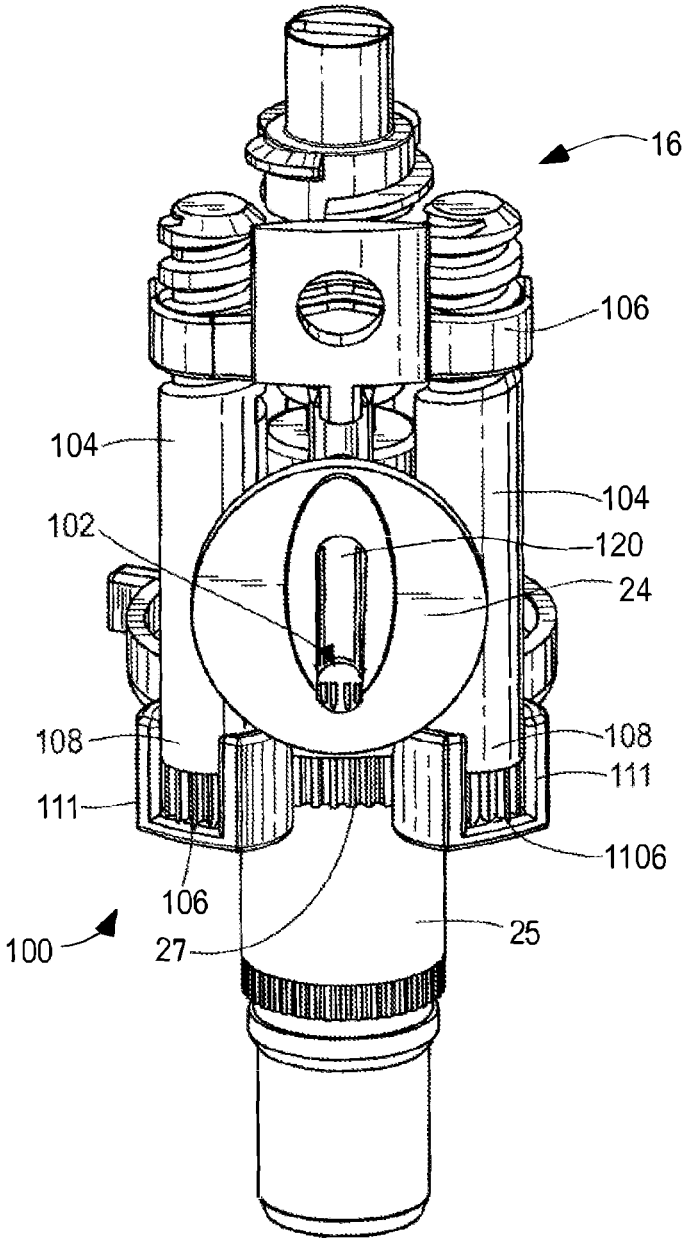
Figure 5:
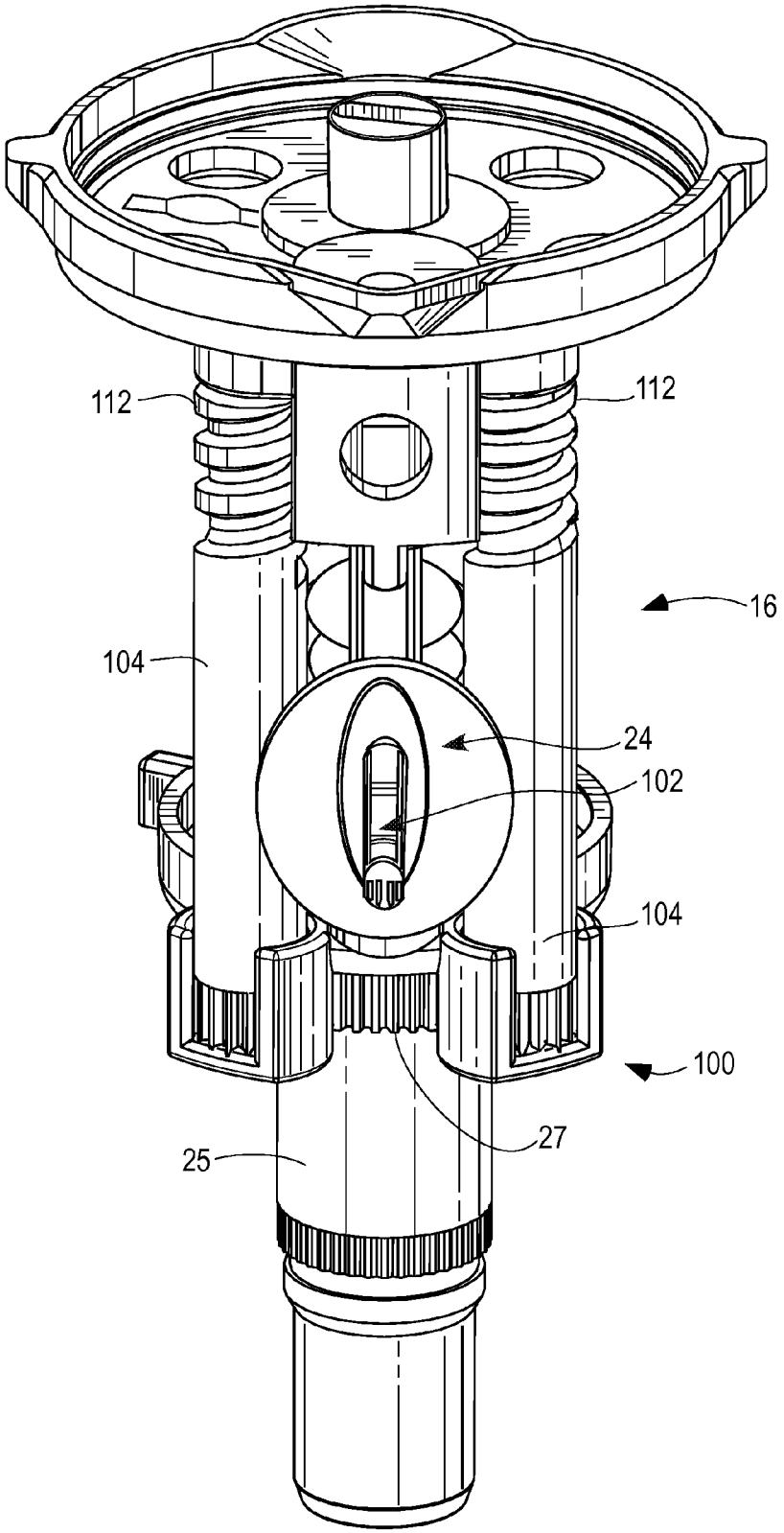
FIG. 5 is a perspective view of a nozzle turret.

By one approach and as best shown in FIGS. 3, 4, and 7, the automatic matched precipitation mechanism 100 includes at least one, and as shown, two jack screws 104 spaced on either side of the outlet. Each jack screw 104 has a gear 106 defined or mounted on a lower or distal end 108 thereof. As best shown in FIG. 7, the gear 106 is mated via a second geared relationship 110 to the ring rear 27 of the arc set mechanism 20. Thus, adjustments of the stop tabs 26 and 28 as described above via adjustment of the actuator 21 and rotation of the ring gear 27 also imparts a corresponding rotational movement to the jack screw(s) 104 via its geared relationship 110 to the same ring gear 27 as best illustrated in FIG. 7.

The jack screw(s) 104 is mounted in the housing 36, such as in screw pockets 111, sized to allow rotational movement of the screws. The jack screw 104 is operable to transfer or impart an axial movement to a lift member or bar 106 containing a flow control member 120 that interacts with the nozzle. That is, as the jack screw 104 is rotated, it is operable to raise or lower the lift bar 106 within the nozzle turret 16 or housing 36. Thus, as the arc of rotation of the nozzle turret 16 is increased (or decreased) via manual adjustment of the actuator 21 as discussed above, the jack screw(s) 104 is configured to automatically axially raise (or lower) the lift bar 106 within the nozzle housing 36 at the same time. To this end and as generally shown in FIGS. 3 and 8, the lift bar 106 includes an elongate base 107 extending across and within the housing 36. In the approach shown in the Figures, the base 107 includes two side wings 109 with each wing defining at least one internally threaded bore 113. The jack screw 104 may also include an outer surface defining outer threads 112. The outer threads 112 are mated with the internal threads of the bore 113.

The lift member or bar 106 further includes the flow control member 120 (such as a gate or gate valve member) depending from a lower surface 122 of the lift bar 106. The gate 120 has one or more surfaces operable to vary the size, shape, configuration, and/or geometry of the outlet 102 of the nozzle 24 to adjust or vary the nozzle flow rate to impart automatic matched precipitation in response to adjustments of the sprinklers arc settings. To this end and by one approach, the gate or flow control member 120 is associated with the fluid nozzle 24 and outlet 102 thereof and mounted for axially shifting relative thereto. By one approach, the gate 120 is an elongate member having a generally flat front surface and a generally flat rear surface and includes a concave or curved notch 122 defined on a lower end 124 thereof. As discussed more below, the concave notch 122 cooperates with an inner edge of the nozzle to define an opening for fluid to exit from the nozzle turret 16.

Turning to FIGS. 6 and 9-12 for a moment, one exemplary coupling between the gate 120 and the nozzle 24 is illustrated. By one approach, the nozzle 24 is a removable insert arranged and configured to be inserted into the nozzle housing wall. The nozzle 24 includes a main body portion 200 with a flared front wall or nozzle plate 202. Various inner edge(s) 204 of the nozzle 24 defines a portion of the fluid outlet 102. The main body 200 defines an access slot or opening 210 at an upper surface thereof. With the approach shown in the figures, the gate 120 is slideably received within the slot or opening 210 and configured to axially shift upwardly and downwardly therein automatically in response to arc set adjustments. For instance, FIG. 6 shows the gate 120 shifted axially upwardly when the lift bar 106 has been moved up via action of the jack screw(s) 104. In this position, the gate 120 is shifted to or adjacent its fully open position as best shown in the front view of FIG. 5. Here, the fluid outlet 102 has its largest opening or configuration as defined by its inner edge 204 and, in some approaches, portions of the notch 122.

As the arc adjustment is effected in an opposite direction, the lift bar 106 is axially shifted downwardly via the actions discussed above to drive the gate 120 axially into the slot 210 and further into the nozzle 24. Upon such shifting of the gate 120, it is lowered to an intermediate and/or lower position, such as that shown in FIG. 4, defining a smaller fluid outlet 102. Here, the gate provides a much smaller outlet opening and the outlet is defined by portions of the nozzle inner edge 204 and portions of the gate notch 122. It will be appreciated that the gate 120 can be shifted into and out of the slot 210 as needed for a particular flow rate depending on the arc settings in order to match precipitation to a desired level. The positions shown in FIGS. 4 and 6 are only exemplary and not intended to be limiting in any way.

In some approaches, the gate valve 120 is operable to automatically shift to a form a profile of the fluid outlet 102 defined by a portion of the gate valve 102, such as notch 122, and a portion of the nozzle turret or nozzle edge 204. In some instances, the outlet profile has a ratio of a height, which may be generally along the longitudinal axis X, to a width transverse to the longitudinal axis of about 0.8:1 to about 1.2:1 (in some cases, about 0.7:1 to about 1.5:1, in other cases, about 0.9:1 to about 1.1:1, and in yet other cases, about 1:1 at about 90° of rotation) when the arc adjustment mechanism is adjusted to about 80° to about 100° arc of rotation. This is often called a flow output aspect ratio. The same gate valve 120 and nozzle 24 may also be operable to automatically shift to a form a different profile or geometry of the fluid outlet 102 defined by a portion of the gate valve, such as the notch 122, and a portion of the nozzle turret or nozzle edge 204 with a different ratio of height to width. The different ratio may be the result of an adjustment to the arc of rotation and may be at least about 4:1 or greater when the arc adjustment mechanism is adjusted to about 250° to about 360° arc of rotation. Thus, one nozzle is arranged and configured to provide a fluid outlet 102 with a height to width ratio of about 1:1 to about 4:1 or greater as needed to automatically match a desired precipitation to arc of rotation settings.

Figure 9:
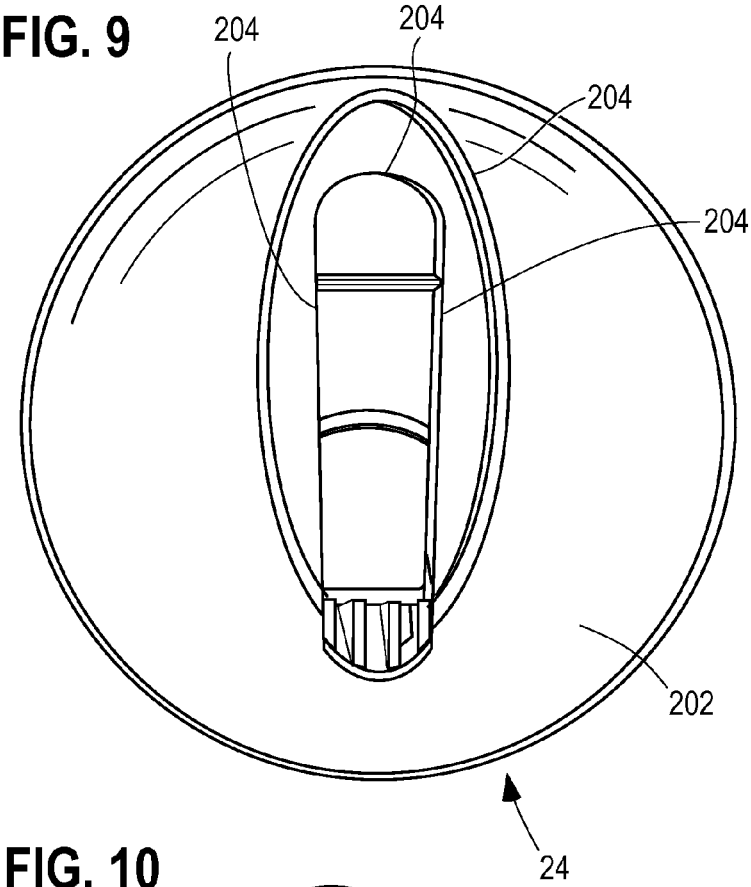
FIG. 9 is a front view of an exemplary nozzle.
Figure 10:
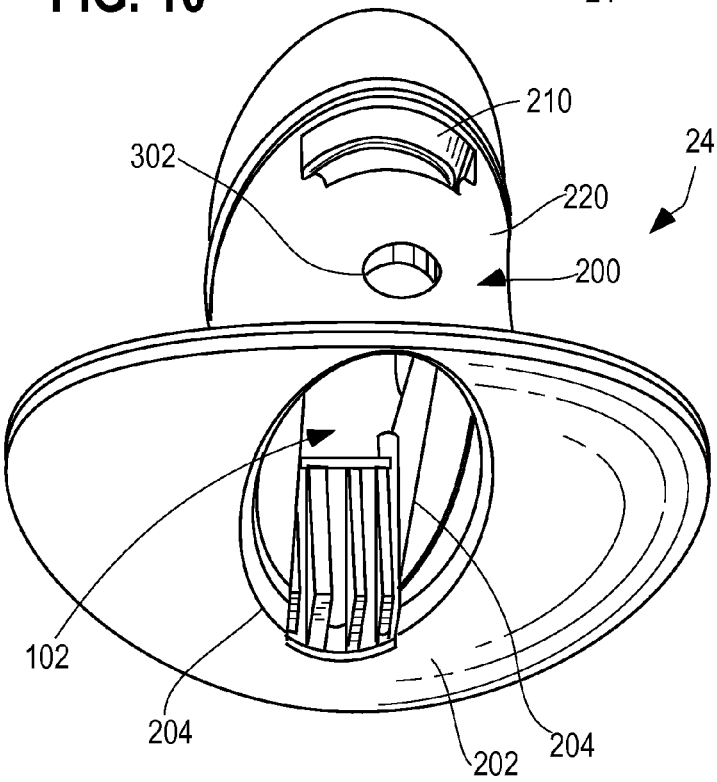
FIG. 10 is a top perspective view of an exemplary nozzle.
Figure 11:
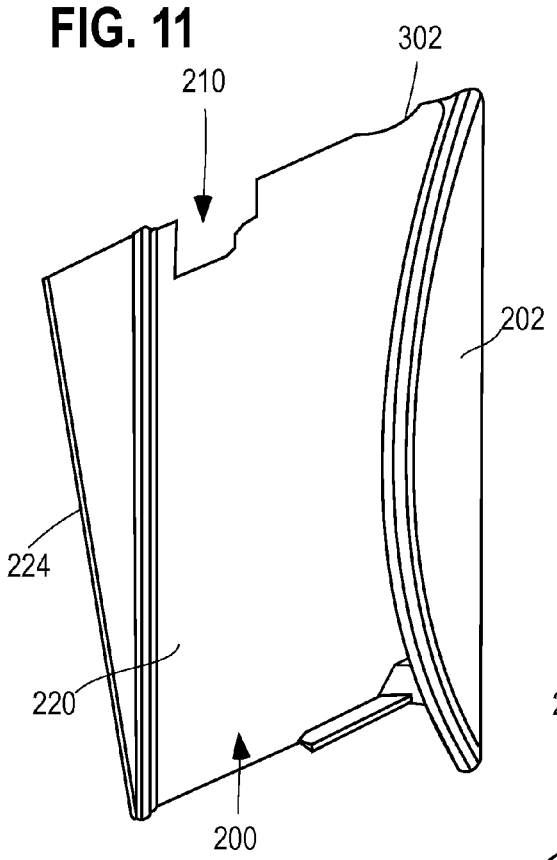
FIG. 11 is a side view of an exemplary nozzle
Figure 12:
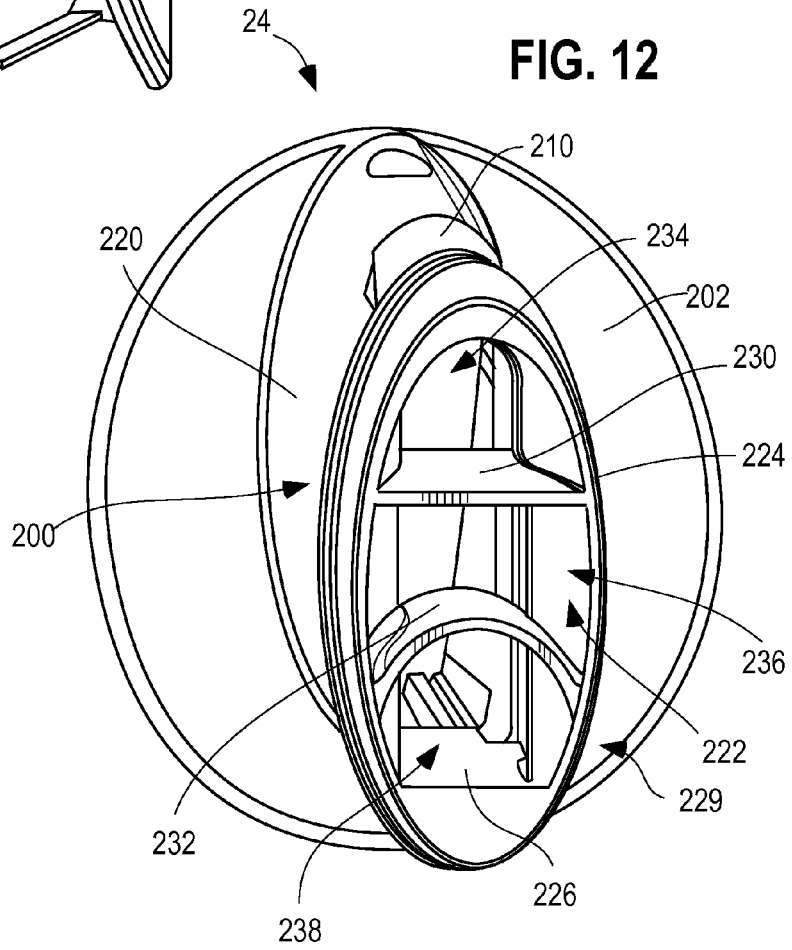
FIG. 12 is a rear perspective view of an exemplary nozzle.
Figure 13:
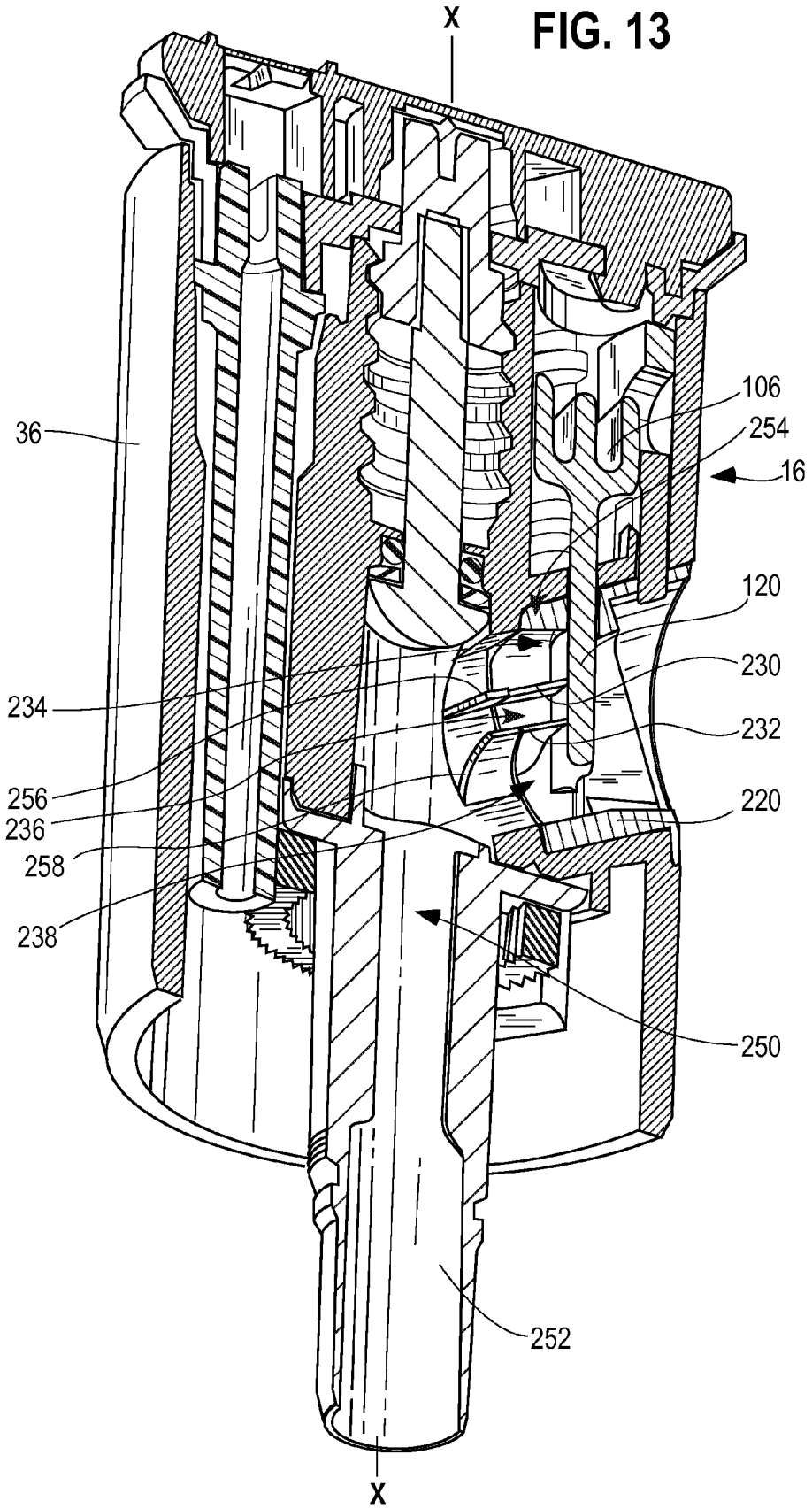
FIG. 13 is a cross-sectional view of a nozzle turret.

Turning now to FIGS. 9, 12, and 13, the flow control vanes of the nozzle and/or the nozzle housing will be described in more detail. The vanes are advantageous because in the context of the variable nozzle geometry of the sprinklers herein, the vanes impart stable flow through the nozzle to reduce turbulence in order to maintain higher fluid energies and, thus, consistent spray distances from the nozzle when the nozzle geometry is altered during arc adjustments. The nozzle main body 200 includes an outer wall 220 defining an internal flow passage 222 for directing irrigation fluid outwardly from the nozzle turret 16. The passage 222 extends from a back end 224 of the nozzle through the main body to the front plate 202. As shown, the passage 222 is an elongate flow passage defining a height longer than the length of the passage. Internally to the passage 222 are a plurality of flow vanes 229, and in one approach, two flow vanes 230 and 232 are provided. The vanes extend partway into the passage from the back end thereof and, in the exemplary approach shown, are located upstream of the slot 210 and, thus, gate valve 120 when it is deployed into the nozzle 24. By one approach, the vanes 229 extend laterally across the passage 222 from one side of the main body to the other.

In one approach, the first vane 230 has a generally flat profile relative to the bottom surface 226 of the passage 222. By one approach, the vane 230 is generally parallel to the passage bottom surface 226. The second vane 232 may have a curved or arcuate profile wherein it curves upwardly toward the flat vane 230. In this configuration, the vanes 230 and 232 define or divide the main passage 222 into three distinct fluid sub-passages 234, 236, and 238. The vanes and sub-passages help reduce turbulence and maintain a substantially laminar flow to keep the fluid energy high, which maintains spray distance from the sprinkler. It will be appreciated that depending on the axial position of the gate 120, one, two, or all three of the sub-passages may be exposed for irrigation fluid. For example, FIG. 13 shows the gate 120 axially shifted downwardly into the passage and blocking sub-passages 234 and 236. By one approach, the curvature of the second vane 232 may be the same or substantially the same as the curvature of the distal end or notch 122 of the gate 120.

Turning to FIG. 13, the housing or housing wall 36 defining the nozzle turret 16 may also include one or more matching vanes corresponding with vanes 230 and 232 in the nozzle 24. By one approach, the nozzle housing 36 defines an internal passage 250 having an upwardly or axial portion 252 along the longitudinal axis X and a second or transverse portion 254 angled to or transverse to the longitudinal axis. The transverse passage portion 254 is arranged and configured as a transition passage from the main or axial portion 252 to the nozzle passage 222 in the nozzle 24. By one approach, the transverse portion 254 includes vanes 256 and 258 that match or correspond to vanes 230 and 232, respectively. In this approach, each complete vane extends along the fluid flow path where a portion of each vane is defined in a removable nozzle and another portion of the vane is defined in the turret housing upstream of the nozzle where the two portions are configured to form one continuous vane.

Figure 14:
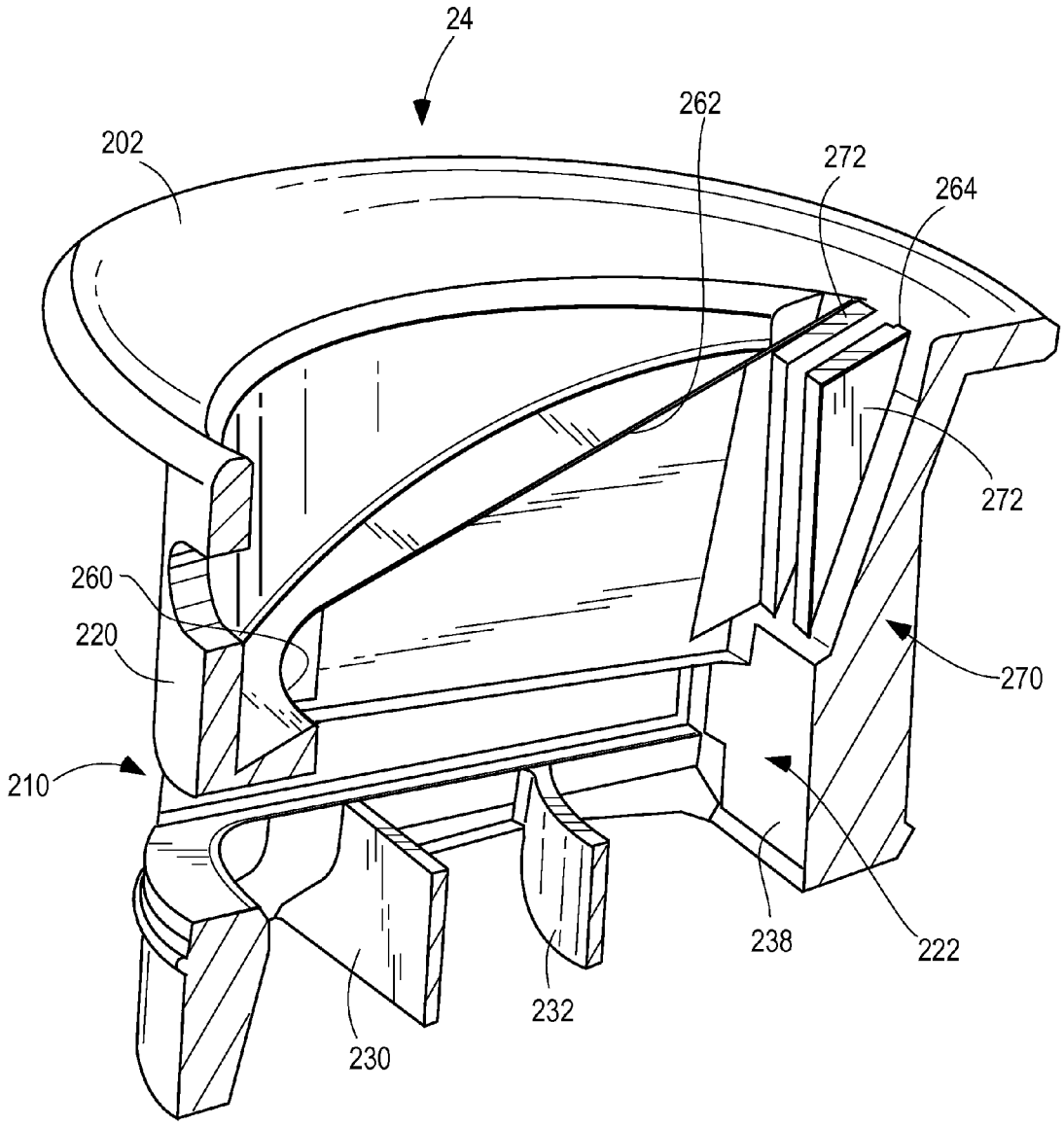
FIG. 14 is a cross-sectional view of an exemplary nozzle.

Turning to FIG. 14 for a moment, the nozzle 24, in accordance with one exemplary form of the sprinkler herein, has the passage 222 formed with a relatively large cross sectional size and shape such as a generally elongate cylindrical shape having an upstream end sized for substantial alignment with a downstream end of the transverse nozzle housing flow path 254. The nozzle faceplate 202 is formed at a downstream end of the nozzle passage 222 and has the variable nozzle outlet 102 formed generally therein. By one approach, this nozzle outlet 102 has a variable size ranging from, in some approaches, a generally elongated and/or a tombstone-shaped configuration or profile to a more uniform square-shaped profile. As shown, the variable outlet profile or geometry is defined by a generally arched or semicircular upper edge 260 joined to relatively straight upright side edges 262 which intersect a lower marginal area 264 that is also relatively flat or straight. In the approach shown herein, the generally arched or semicircular upper edge may be partially or completely formed from the notch 122 in the gate 120 as generally shown, for example, in FIGS. 2 and 4.

So configured, water under pressure projected outwardly from the nozzle 24 via the nozzle outlet 102 generally produces a generally vertically oriented fan-like spray pattern or segment. To aid in forming the fan-like spray pattern. The lower marginal area 264 includes an inclined or downwardly ramped surface 270. By one approach, the ramped surface 270 includes a plurality of individual tapered or ramped surfaces formed generally at a front side of the nozzle faceplate 202, in a side-by-side array spanning a substantial portion and, by one approach, the entire width of the lower marginal area 264 of the nozzle outlet 102. In the illustrated approach, a plurality of side-by-side ramped surfaces 270 are separated by upstanding spacer walls 272 where each ramp surface 270 has a selected transverse width between the spacer walls 272 that may be the same or different. The ramped surfaces extend forwardly and angularly downwardly with a selected declination angle between the spacer walls which may be the same as or different from an adjacent ramp or ramps.

With this construction, the lower edge region 264 of the nozzle 24 is configured to form the lower portions of the vertical fan-like spray at relatively short distances from the sprinkler because irrigation fluid is forced and guided downwardly by the multiple ramps 270 at one or more different angles for achieving significantly improved close-in distribution of water near the sprinkler, with a significant water distribution occurring, in some approaches, substantially at or within a few inches of the sprinkler 12. This close-in water distribution may be configured as small and relatively fine water droplets which fall softly to the ground.

Figure 15:
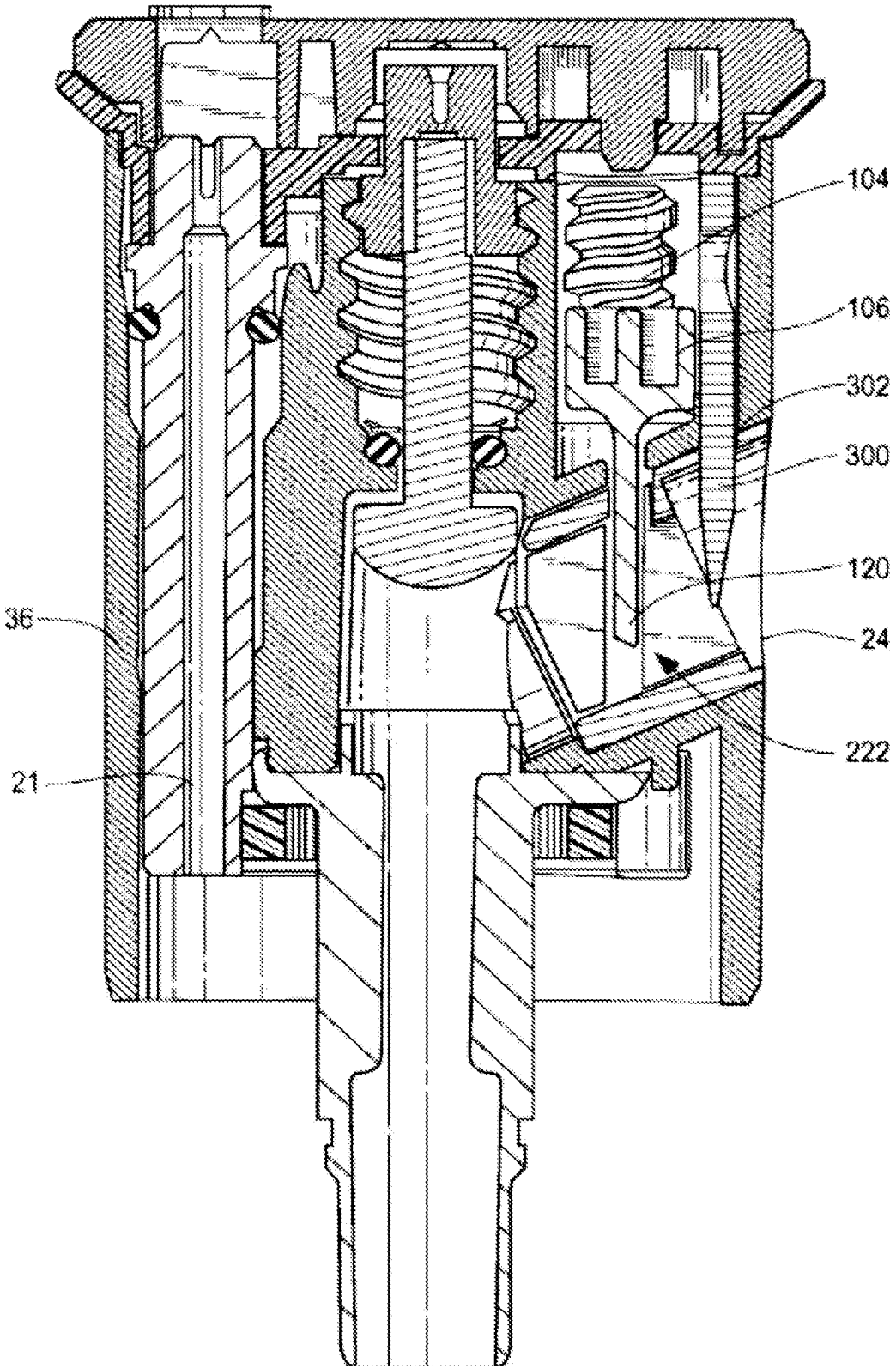
FIG. 15 is a cross-sectional view of a nozzle turret.
Figure 16:
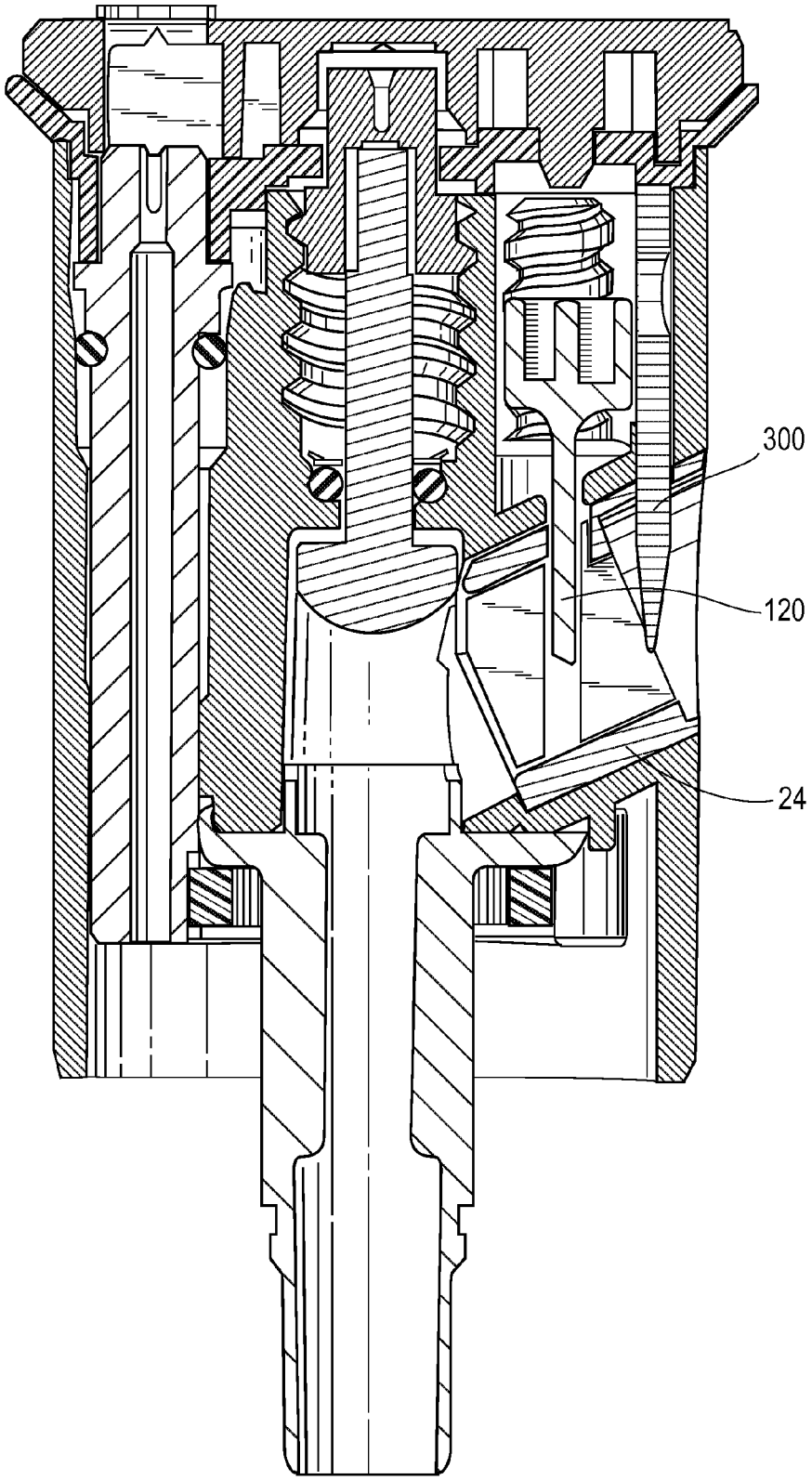
FIG. 16 is a cross-sectional view of a nozzle turret.
Figure 17:
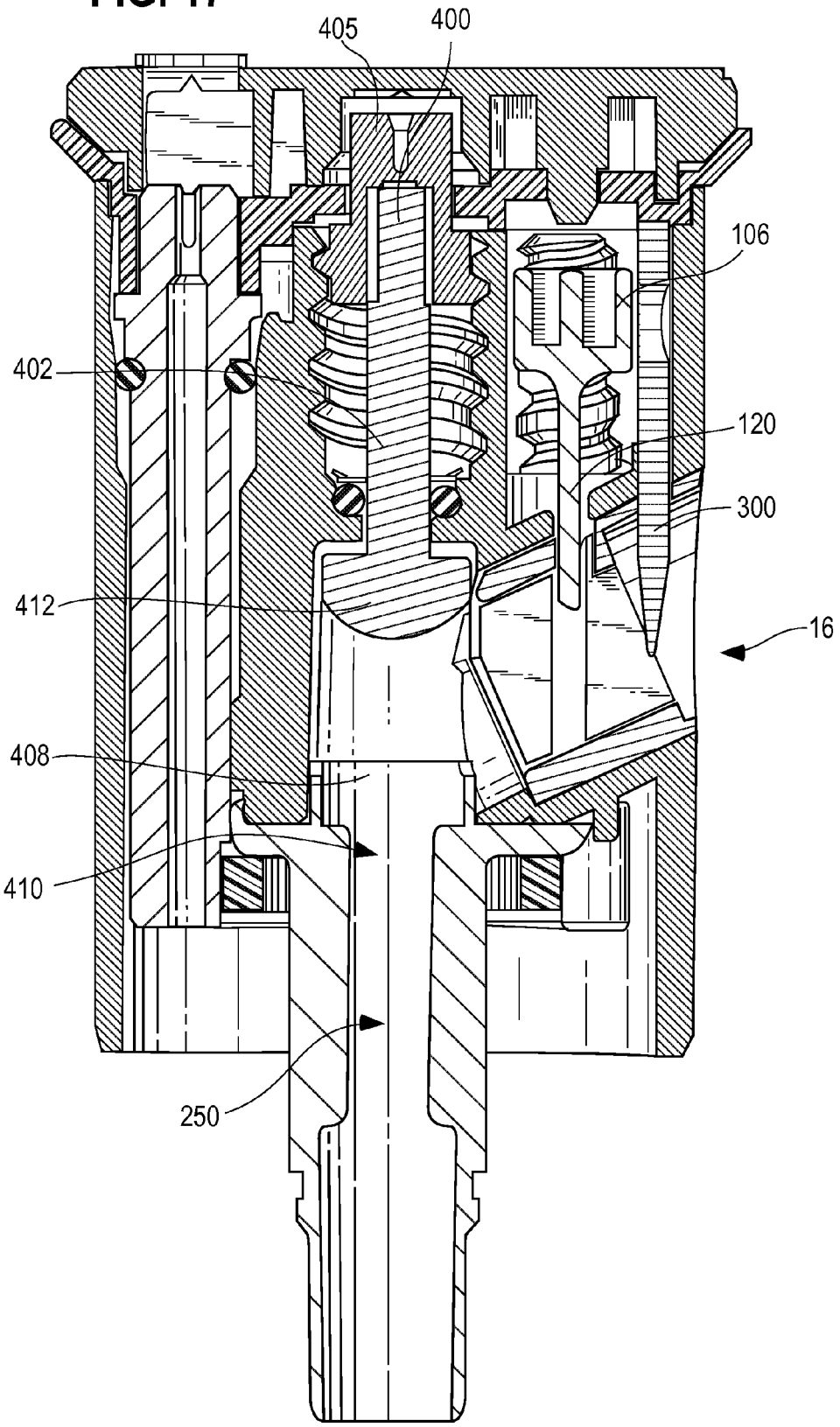
FIG. 17 is a cross-sectional view of a nozzle turret.

Turning now to FIGS. 15-17, the sprinkler housing 36 is illustrated with an optional fixed spray break-up pin 300. The pin 300 is advantageous because, in some approaches, even though it is fixed and does not move, it aids in achieving a substantially constant throw radius upon variations in the nozzle flow when attempting to match precipitation. The pin 300 is mounted to the housing 36 and mounted for no axial movement or shifting thereof relative to the housing 36. The pin 300 is mounted within the housing to extend into the nozzle 24 as generally shown in FIG. 15. To this end and in one approach, the nozzle body 200 defines an aperture or opening 302 (FIGS. 15 and 10) sized for receipt of the pin 300 therein such that the pin is oriented positioned in the nozzle and downstream of the fluid outlet 102 and downstream of the gate 120.

Due to the automatic matched precipitation mechanism 100, depending on the axial positioning of the gate 120, the pin 300 may be fully, partially, or not exposed to the irrigation fluid being projected from the nozzle outlet 102. For instance, FIG. 17 shows the gate 120 at or near its lowest position where the nozzle outlet 102 is defined at or around its smallest size, shape, profile, and/or configuration. Here, the pin is generally not exposed to projected irrigation fluid. FIG. 16 shows the gate 120 shifted axially upwardly to a different fluid outlet opening profile where the pin 300 has a portion thereof exposed for contacting the fluid projected from the nozzle. FIG. 17 shows the gate 120 at or near it highest axial position exposing the fluid outlet to its largest or greatest size, shape, profile, and/or configuration. Here, the pin 300 is fully exposed to the projected irrigation fluid from the nozzle outlet 102, which may be at gate positions associated with about 300 to about 360° of turret rotation. In some approaches, the pin 300 may have a tapered section 304 that is wholly or fully exposed to irrigation fluid in this position.

FIG. 16 shows the gate 120 axially shifted to an intermediate position within the nozzle 24. Here, the pin 300 is partially exposed to irrigation fluid, which may be gate positions associated with 91 to 299° of turret rotation. FIG. 15, on the other hand, shows the gate axially shifted to a position at or near its lowest axial position exposing the fluid outlet to its smallest or most compact size, shape profile, and/or configuration. Here, the pin 300 is not exposed to irrigation fluid, which may be at gate positions associated with about 90° or less of turret rotation. The variations in pin exposure to irrigation fluid all occur without any movement of the pin itself.

Turning back to FIG. 17, the cross-sectional view of the sprinkler further shows an exemplary flow shut-off or flow-control valve 400. In one approach, the shut-off valve 400 includes a plunger 402 positioned coaxial to the upwardly directed flow tube 250 that directs fluid upwardly towards the nozzle 24. The plunger 402 moves axially upwardly and downwardly in response to a user turning an actuator 405. By one approach, the plunger 402 is configured to shift axially up and down within the flow tube 250. In some approaches, if the plunger 402 is moved far enough, it may completely close off an opening or aperture 408 at an upper end 410 of the flow tube 250, which completely blocks water flow to the nozzle.

If the plunger 402 is moved to intermediate position within the flow tube or passage 251, where it only partially blocks the aperture 208, then it will decrease or vary the flow of water to the nozzle 24. By one approach, the plunger 402 has a tapered, curved, or pointed lower end 412 configured to progressively restrict nozzle flow as it is lowered into the flow tube 250. The tapered end 412 decreases the size of the flow tube opening 408 to restrict flow to the nozzle 24.

It will be understood that various changes in the details, materials, and arrangements of parts and components which have been herein described and illustrated in order to explain the nature of the sprinkler may be made by those skilled in the art within the principle and scope of the sprinkler as expressed in the appended claims. Furthermore, while various features have been described with regard to a particular embodiment, it will be appreciated that features described for one embodiment may also be incorporated with the other described embodiments.

What is claimed is:

1. A rotary sprinkler comprising:

a housing with an inlet for receiving fluid for irrigation, the housing having a longitudinal axis;

a nozzle defining an outlet with a variable geometry for projecting irrigation fluid from the sprinkler, the nozzle mounted for rotation relative to the housing;

a drive mechanism for rotating the nozzle in a reversible arc of rotation between a pair of stops defining ends of the reversible arc of rotation;

an arc adjustment mechanism coupled to at least one of the stops, the arc adjustment mechanism arranged and configured upon adjustment thereof to increase or decrease the arcuate distance between the pair of stops to increase or decrease the arc of rotation of the nozzle; and a flow control member arranged and configured to shift in an axial direction relative to the nozzle to vary the geometry of the outlet, the flow control member operably coupled to the arc adjustment mechanism such that adjustment of the at least one stop is operable to shift the flow control member in the axial direction to change the geometry of the outlet to adjust a flow rate through the outlet proportional to the arc of rotation.

2. The rotary sprinkler of claim 1, wherein the flow control member is a gate.

3. The rotary sprinkler of claim 2, wherein the gate has a concave lower end defining an upper surface of the variable geometry outlet.

4. The rotary sprinkler of claim 2, wherein the gate is operably coupled to the arc adjustment mechanism using a geared relationship.

5. The rotary sprinkler of claim 4, wherein the geared relationship includes at least one axially oriented jack screw, the gate and the arc adjustment mechanism coupled to the at least one axially oriented jack screw.

6. The rotary sprinkler of claim 1, wherein the flow control member automatically shifts in the axial direction upon actuation of the arc adjustment mechanism to form a profile of the variable geometry outlet defined by a portion of the flow control member and a portion of the nozzle with a ratio of an outlet height to an outlet width of about 0.8:1 to about 1.2:1 when the arc adjustment mechanism is adjusted to about 80° to about 100° arc of rotation.

7. The rotary sprinkler of claim 6, wherein the flow control member automatically shifts in the axial direction upon actuation of the arc adjustment mechanism to form a different profile of the variable geometry fluid outlet defined by a portion of the flow control member and a portion of the nozzle with a ratio of the outlet height to the outlet width of at least about 4:1 when the arc adjustment mechanism is adjusted to about 250° to about 360° arc of rotation.

8. The rotary sprinkler of claim 1, wherein the nozzle includes at least one flow control vane extending transversely across a passage upstream of the outlet.

9. The rotary sprinkler of claim 8, wherein the nozzle includes two axially spaced flow control vanes in the passage, one flow control vane having a generally flat profile and the second flow control vane having a generally arcuate profile.

10. The rotary sprinkler of claim 8, wherein the at least one flow control vane is disposed in the nozzle upstream of the flow control member.

11. The rotary sprinkler of claim 1, further including a fixed flow break-up member mounted for no axial movement thereof, the fixed flow break-up member depending downwardly adjacent to the outlet and configured for exposure to irrigation fluid exiting the outlet based on the axial position of the flow control member.

* * * * *